US010925389B1

(12) United States Patent
Manno et al.

(10) Patent No.: US 10,925,389 B1
(45) Date of Patent: Feb. 23, 2021

(54) SHELF SUPPORT SHROUD AND METHOD OF USE

(71) Applicant: Stephen Manno, Sayville, NY (US)

(72) Inventors: Stephen Manno, Sayville, NY (US); Herbert Frederick Ruschmann, East Norwich, NY (US)

(73) Assignee: Stephen Manno, Sayville, NY (US)

( * ) Notice: Subject to any disclaimer, the term of this patent is extended or adjusted under 35 U.S.C. 154(b) by 0 days.

(21) Appl. No.: 16/409,852

(22) Filed: May 12, 2019

(51) Int. Cl.
*A47B 21/06* (2006.01)
*A47B 96/06* (2006.01)

(52) U.S. Cl.
CPC ..... *A47B 21/06* (2013.01); *A47B 96/06* (2013.01); *A47B 2021/066* (2013.01); *A47B 2220/0091* (2013.01)

(58) Field of Classification Search
CPC ..... A47B 96/022; A47B 21/06; A47B 96/06; A47B 2021/066; A47B 2220/0091
USPC ..... 108/42, 47; 312/351
See application file for complete search history.

(56) References Cited

U.S. PATENT DOCUMENTS 577,204 A * 2/1897 Patten ..... A47B 61/00 312/213
1,064,843 A * 6/1913 Marsh ..... A47B 96/061 108/152
1,330,262 A 2/1920 Hallam
2,957,587 A * 10/1960 Tobin ..... E03C 1/06 108/27
3,279,871 A * 10/1966 Bright ..... H05K 5/06 312/223.1
3,471,978 A * 10/1969 Fenwick ..... A47F 5/103 52/36.6
4,181,382 A * 1/1980 Harvey ..... A47B 95/008 108/152
4,339,045 A 7/1982 Bodin
4,909,158 A * 3/1990 Sorensen ..... A47B 77/10 108/40
5,020,448 A * 6/1991 Treadway ..... A47B 46/00 108/42
5,097,771 A * 3/1992 James, III ..... A47B 23/00 108/108
5,318,356 A * 6/1994 Shelton ..... B26B 19/3873 312/223.1
5,460,101 A * 10/1995 Garbutt, Sr. ..... A47B 5/04 108/40
5,577,819 A * 11/1996 Olsen ..... A47B 67/00 312/209
5,623,880 A * 4/1997 Kuntz ..... A47K 10/38 108/42

(Continued)

*Primary Examiner* — Jose V Chen
(74) *Attorney, Agent, or Firm* — Herbert F. Ruschmann; Law Office of Herbert F. Ruschmann

(57) ABSTRACT

A shelf unit comprises a shelf and a support shroud. The support shroud defines a shroud concavity extending from the upper wall perimeter edge to the lower wall perimeter edge and bounded by the left and right side edges. The shelf is connected to the support shroud at a position disposed over the upper wall perimeter edge. The shelf optionally has a shelf aperture in communication with the shroud concavity. The shelf unit may be mounted with the shroud covering a wall outlet and an electronic device, disposed on the shelf, has cabling which passes through the shelf aperture and into the shroud concavity. In this application the cabling is contained in the shroud concavity.

48 Claims, 8 Drawing Sheets

(56) References Cited

U.S. PATENT DOCUMENTS

| | | | | |
|---|---|---|---|---|
| 5,899,147 | A * | 5/1999 | Clayton | A47B 96/028 108/108 |
| 5,917,694 | A * | 6/1999 | Denny | A45D 1/00 206/372 |
| 6,026,605 | A * | 2/2000 | Tippett | H01H 9/18 174/66 |
| 6,246,573 | B1 * | 6/2001 | Khan | G06F 1/16 312/223.2 |
| 6,329,597 | B1 | 12/2001 | Kaloustian | |
| 6,382,749 | B1 | 5/2002 | Stetson | |
| 6,427,606 | B1 | 8/2002 | Klotz | |
| 7,528,323 | B2 | 5/2009 | Wu et al. | |
| 8,134,075 | B1 | 3/2012 | Vail | |
| 2004/0112258 | A1 * | 6/2004 | Fichman | A47B 5/04 108/38 |
| 2005/0248248 | A1 * | 11/2005 | Moss | A47B 96/022 312/351 |
| 2007/0159035 | A1 | 7/2007 | Mullen | |
| 2011/0297053 | A1 * | 12/2011 | Martin | A47B 13/003 108/42 |
| 2013/0087083 | A1 * | 4/2013 | Martinez | A47B 96/02 108/42 |
| 2013/0206446 | A1 | 8/2013 | Briede et al. | |

* cited by examiner

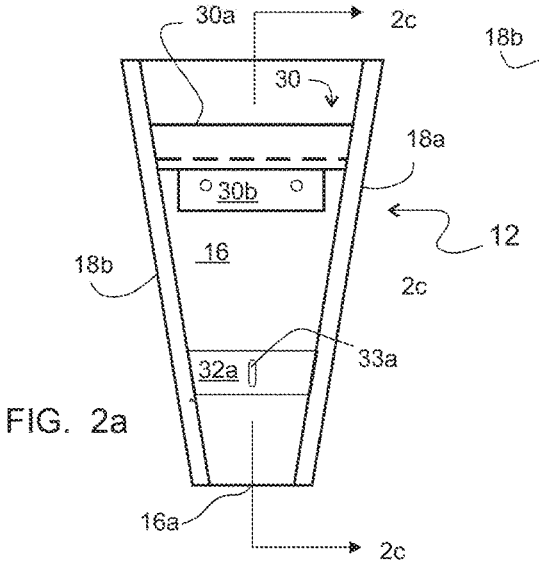
FIG. 2a
FIG. 2b
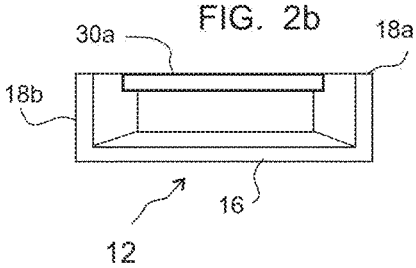
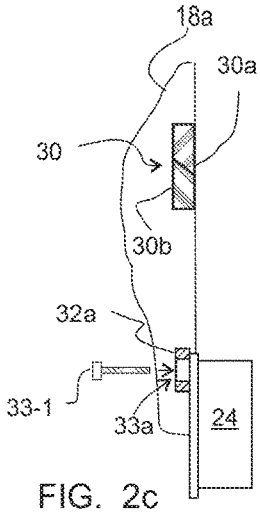
FIG. 2c
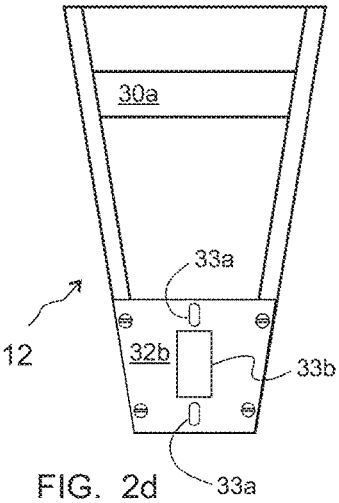
FIG. 2d
FIG. 3a
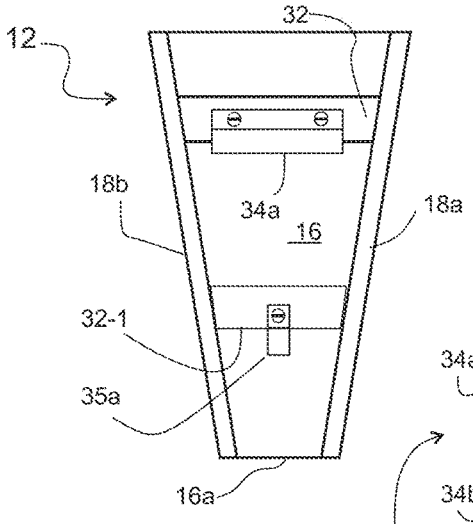
FIG. 3b
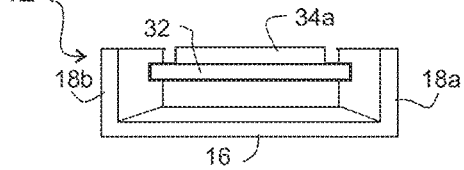
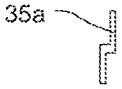
FIG. 3e
FIG. 3c
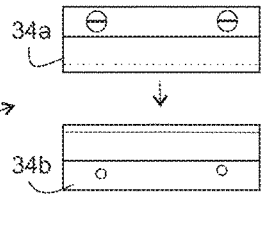
FIG. 3d
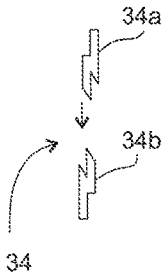
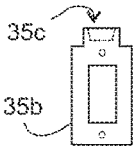
FIG. 3f
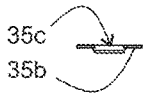
FIG. 3g
35c FIG. 4a
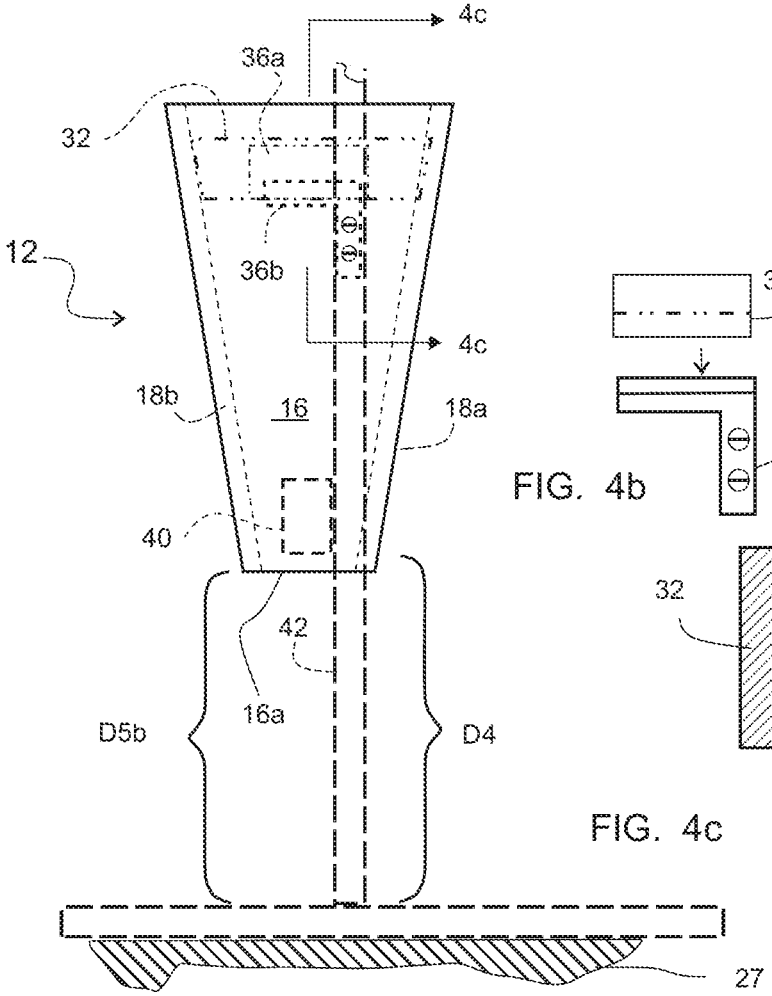
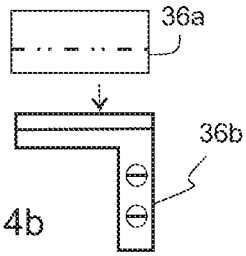
FIG. 4b
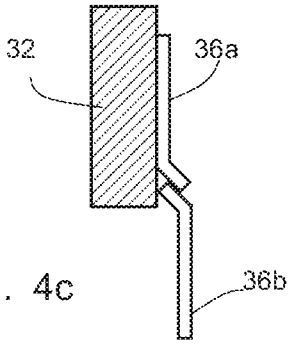
FIG. 4c
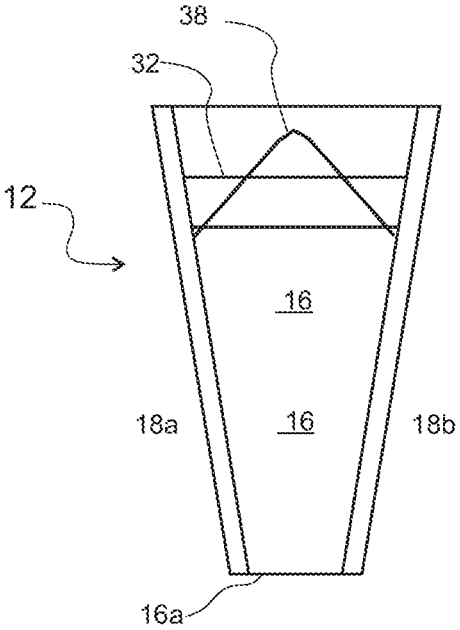
FIG. 5

SHELF SUPPORT SHROUD AND METHOD OF USE

BACKGROUND

The present invention relates to a device and method for providing a supported surface for carrying electronic devices, protecting wired connections to wall outlets from disturbance, preventing distraction and/or a shock hazard to children, and managing wiring and cables associated with electronic devices. More particularly, disclosed herein are embodiments of a shelf unit incorporating a support shroud and shelf which is configured to achieve one or more of the aforementioned functions. Further provided is a method for managing wiring, concealing potential hazards from children, providing an installation method for supporting electronic devices and managing connections thereto.

In the prior art it is known to provide shelf brackets which support shelves from building walls. The brackets, in combination with a shelf, serve to support objects including electronic devices. Such brackets include L-shaped brackets which in pairs support a shelf from underneath, support bracket systems which have vertical standards into which shelf brackets interlock, or self-supports shelf racks which stand on a floor. Since many electronic devices require power and/or communication connections to systems in the building via wall outlet connections, it is necessary that cabling, power cords and other wiring extend downward from the shelf to a wall outlet. Such an arrangement leaves the various cables, cords, and wiring prone to being disturbed inadvertently and by inquisitive children. Hence, there is a need for a shelf mounting arrangement for operably supporting electronic devices.

Typical shelving mounted on brackets and supporting electronic devices allows for cabling, cords, and wiring to dangle free therefrom. Often lengths of such connecting lines are longer than necessary and fall to the floor or require that the connecting lines be wrapped or bundled to prevent tangling and exposure to being caught on moving objects such as vacuums, carts or other contrivances passing the shelf installation. Thus, a method and device for easily handling such connecting lines and preventing disturbance thereof is desired.

Furthermore, exposed wall outlets are a tempting distraction for small children. Various covering devices that attach to wall outlets and tamper proof wall outlets are known. These devices can prove to be bothersome to remove or place in a connection permitting state when a connection to a wall outlet is to be made. While such devices are resistant to children, they do not address issues concerning wall outlets which have cabling, cords, wiring connected thereto which are prone to being removed by children or disturbed by.

SUMMARY

Accordingly, it is an object of the invention to provide a shelf unit which overcomes one or more of the drawbacks of the prior art. Briefly stated, a shelf unit comprises a shelf and a support shroud. The support shroud has a shroud wall including an upper wall perimeter edge and a lower wall perimeter edge, and left and right side edges extending from the upper wall perimeter edge to the lower wall perimeter edge. The support shroud defines a shroud concavity extending from the upper wall perimeter edge to the lower wall perimeter edge and bounded by the left and right side edges. The shelf is connected to the support shroud at a position disposed over the upper wall perimeter edge. The shelf has a shelf aperture in communication with the shroud concavity. An electronic device is disposed on the shelf and has cabling which passes through the shelf aperture and into the shroud concavity. The shelf unit is mounted on a building wall with support shroud covering a wall outlet. The cabling is connected to the wall outlet and contained in the support shroud concavity.

In an embodiment of a shelf unit of the present invention, it is an optional feature that the support shroud wall includes an access panel displaceable relative to a remainder of the support shroud. As a further optional feature the access panel is rotatably mounted to the remainder of the support shroud wall at a lower half of the support shroud. In an alternative variation the access panel is rotatably mounted to the support shroud at an upper half of the support shroud. In yet another variation the access panel is rotatably mounted to the support shroud via a rotatable connection to the shelf.

It is a further optional feature of the above embodiments and others disclosed herein that the lower wall perimeter has a depth in a range of about 2 and ¾ inches to about 5 inches and a width in a range of about 3 and ½ inches to 6 and ¾ inches. In a variation of this feature the lower wall perimeter has a depth in a range of about 2 inches to about 6 inches and a width in a range of about 3 and ½ inches to 12 and ¾ inches. Various further ranges are set forth which are dictated by particular applications of embodiments of the present invention.

It is a further optional feature of the above embodiments and others disclosed herein that the upper wall perimeter edge subtends a larger area than the lower wall edge perimeter such that the shroud concavity of the support shroud a has a tapering configuration tapering inward with advancement in a descending direction. The tapering configuration may have various forms and optionally serves to retain cabling within the support shroud by virtue of a funneling effect and constriction at a lower end which is optionally in part contributed to by cabling connected to the wall outlet.

In a further embodiment of the present invention a method of containing cabling communicating an electronic device with a wall outlet is provided and comprises in part providing a support shroud having a shroud wall including an upper wall perimeter edge and a lower wall perimeter edge, and left and right side edges extending from the upper wall perimeter edge to the lower wall perimeter edge, and defining a shroud concavity extending from the upper wall perimeter edge to the lower wall perimeter edge and bounded by the left and right side edges. Further included is mounting the support shroud on a wall having the wall outlet in a manner so that the support shroud covers the wall outlet, providing a shelf having a shelf aperture and situating the shelf supported on the support shroud at a position disposed over the upper wall perimeter edge of the support shroud with the shelf aperture in communication with the shroud concavity. The method then entails disposing the electronic device on the shelf, connecting the cabling of the electronic device to the wall outlet with the cabling extending through the shelf aperture and within the shroud concavity, and disposing excess portions of the cabling contained within the shroud concavity.

In a further embodiment of the present invention the method also comprises providing the support shroud wall with an access panel displaceable relative to a remainder of the support shroud, and disposing the support shroud with the access panel proximate the wall outlet so as to provide manual access to the outlet. The connecting the cabling with the wall outlet the comprises accessing an end of the cabling by opening the access panel, connecting the end of the cabling to the wall outlet, closing the access panel, and feeding a remainder of the cabling through the shelf aperture such that the cabling remains within the shroud concavity.

In the above and other embodiments of the method of the present invention it is a feature to configure the support shroud such that the shroud concavity of the support shroud has a tapering configuration tapering inward with advancement in a descending direction and further defined by the upper wall perimeter edge subtending a larger area than the lower wall edge perimeter. The lower wall edge perimeter dimension is then set to restrict the cabling, in conjunction with the cabling end being connected to the wall outlet, from falling below the support shroud when the cabling is loosely disposed in the shroud concavity after closing the access panel.

In the above and other embodiments of the method of the present invention an optional feature entails feeding the cabling through the shelf aperture such that the cabling reaches the wall outlet, manually reaching up through an area subtended by the lower wall edge perimeter and inserting an end of the cabling into connection with the wall outlet, and feeding a remainder of the cabling through the shelf aperture such that the cabling remains within the shroud concavity.

The above, and other objects, features and advantages of the present disclosure will become apparent from the following description read in conjunction with the accompanying drawings, in which like reference numerals designate the same elements. The present disclosure is considered to include all functional combinations of the above described features and corresponding descriptions contained herein, and all combinations of further features described herein, and is not limited to the particular structural embodiments shown in the figures as examples. The scope and spirit of the present disclosure is considered to include modifications as may be made by those skilled in the art having the benefit of the present disclosure which substitute, for elements presented in the claims, devices or structures upon which the claim language reads or which are equivalent thereto, and which produce substantially the same results associated with those corresponding examples identified in this disclosure for purposes of the operation of this disclosure. Additionally, the scope and spirit of the present disclosure is intended to be defined by the scope of the claim language itself and equivalents thereto without incorporation of structural or functional limitations discussed in the specification which are not referred to in the claim language itself.

The foregoing is a summary and thus contains, by necessity, simplifications, generalizations, and omissions of detail; consequently, those skilled in the art will appreciate that the summary is illustrative only and is not intended to be in any way limiting. Additional features and advantages of various embodiments of the present disclosure will be set forth in part in the non-limiting description that follows, and in part, will be apparent from the non-limiting drawings, or may be learned by practice of various embodiments. The objectives and other advantages of various embodiments will be realized and attained by means of the elements and combinations particularly pointed out in the description and appended claims.

BRIEF DESCRIPTION OF THE DRAWINGS

In part, other aspects, features, benefits and advantages of the embodiments of this disclosure will be apparent with regard to the following description, appended claims and accompanying drawings wherein:

FIG. 2*a* is a rear side elevation view of an embodiment of a support shroud of the shelf unit of FIG. 1*a* having a French cleat mounting arrangement;

FIG. 2*b* is a top plan view of the support shroud of FIG. 2*a;*

FIG. 2*c* is a cross-sectional partial view of the support shroud of FIG. 2*a* take along line 2*c*-2*c* of FIG. 2*a;*

FIG. 2*d* is a rear side elevation view of the support shroud of FIG. 2*a* shown having a mounting plate carried on a lower portion thereof and configured for engagement with a wall outlet in place of a standard wall outlet faceplate.

FIG. 3*a* is a rear side elevation view of another embodiment of a support shroud of the shelf unit of FIG. 1*a* having a wall cleat mounting arrangement at a top portion and a hood device at a lower portion;

FIG. 3*b* is a top plan view of the support shroud of FIG. 3*a;*

FIG. 3*c* is an exploded view of the wall cleat of FIG. 3*a;*

FIG. 3*d* is a side view of the wall cleat of FIG. 3*c;*

FIG. 3*e* is a side view of the hook device of FIG. 3*a;*

FIG. 3*f* is a front side view of an eye plate configured for installation on a wall outlet in place of a standard wall outlet faceplate and for acceptance of the hook device of FIG. 3*e;*

FIG. 3*g* is a top plan view of the eye plate of FIG. 3*f* showing an eye notch for receiving the hook device of FIGS. 3*a* and 3*e;*

FIG. 4*a* is a front elevation view of another embodiment of a support shroud shown mounted to a wall stud using a further wall cleat mounting configuration and positioned over a wall outlet;

FIG. 4*b* is an exploded view of an embodiment of a wall cleat shown in FIG. 4*a;*

FIG. 4*c* is a cross-sectional view of the wall cleat shown in FIG. 4*a* taken along lines 4*c*-4*c;*

FIG. 5 is a rear elevation view of still another embodiment of a support shroud having a hanging wire mounting configuration;

FIG. 17*c* is a cross-sectional partial view of a support shroud of the shelf unit of FIG. 17*a* showing mounting of retainer parts;

Figure 1A:
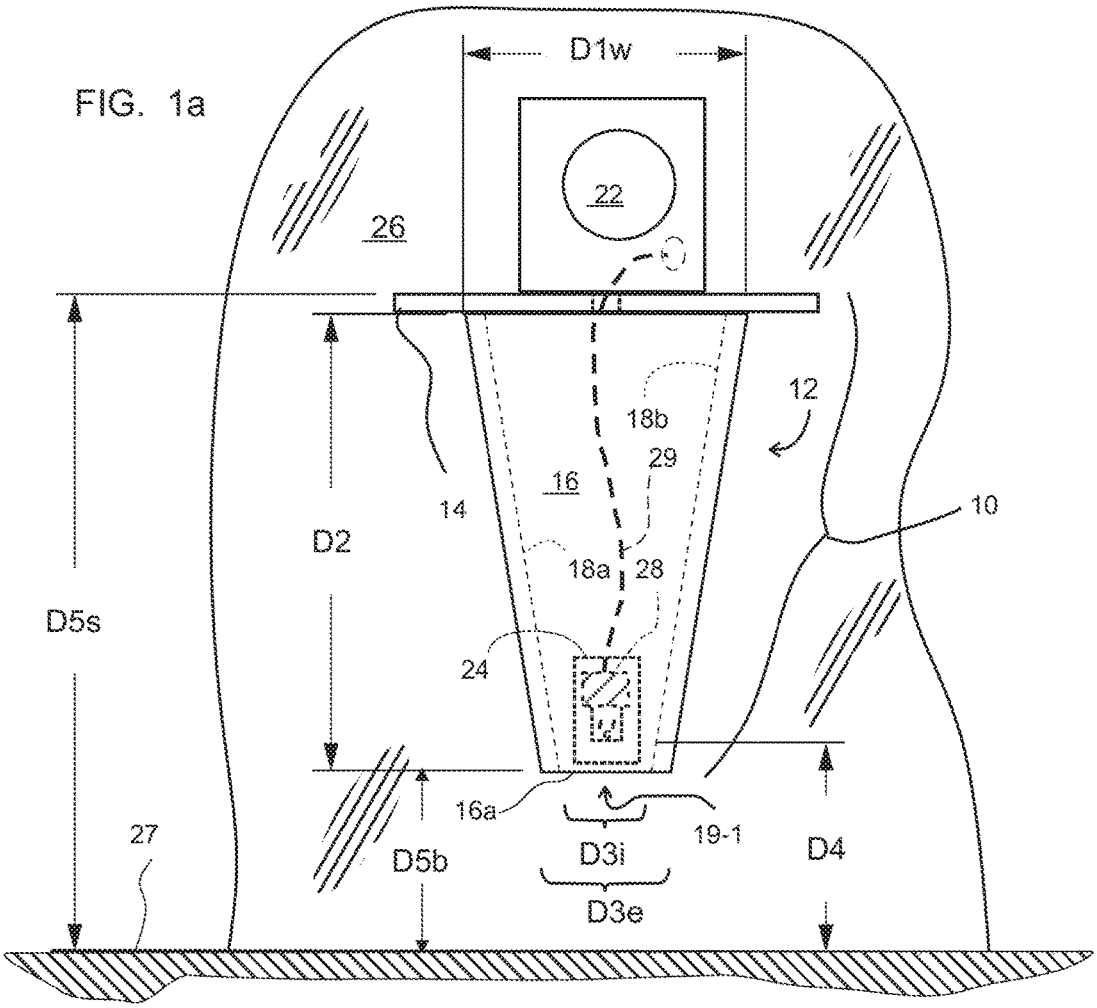
FIG. 1*a* is a front elevation view of an embodiment of a shelf unit 10 of the present invention shown mounted to a building wall, covering a wall outlet and supporting an electronic device having a cord and plug engaged with the wall outlet.

It is to be understood that the figures are not drawn to scale unless so indicated. Further, the relationship between objects in a figure may not be to scale, and may in fact have a reverse relationship as to size unless so indicated. The figures are intended to bring understanding and clarity to the structure of each object shown, and thus, some features may be exaggerated in order to illustrate a specific feature of a structure. Accordingly, the figures are not intended to limit the scope and breadth of the appended claims.

DETAILED DESCRIPTION

Reference will now be made in detail to various embodiments of the present disclosure, examples of which are illustrated in the accompanying drawings. While the embodiments of the present disclosure will be described in conjunction with the illustrated embodiments, it will be understood that they are not intended to limit the disclosure to those embodiments. On the contrary, the disclosure is intended to cover all alternatives, modifications, and equivalents, which may be included within the disclosure as defined by the appended claims. Furthermore, the following explanations of nomenclature, phrasing, and intended interpretations are to be applied when determining meaning of the description and appended claims.

Headings.

Headings where presented below are not meant to limit the disclosure in any way; embodiments under any one heading may be used in conjunction with embodiments under any other heading.

Singular Includes Plurality.

With regard to the following description it is to be understood by those skilled in the art that unless a specific number of an introduced claim element is recited in the claim, such claim element is not limited to a certain number. For example, introduction of a claim element using the indefinite article "a" or "an" to introduce a first element does not limit the claim to "one" of the first element. Still further, it is to be understood that the appended claims may contain usage of the introductory phrases "at least one" and "one or more" to introduce claim elements and that such phraseology does not alter the foregoing interpretation of the articles "a" or "an." Such phrases are not considered to imply that the introduction of a claim element by the indefinite articles "a" or "an" limits any particular claim containing such introduced claim element to coverage of devices or processes containing only one such element or containing more than one such element, even when the same claim includes the introductory phrases "one or more" or "at least one." If an element of this disclosure is intended to be limited to one unit, it will be explicitly stated using any of "just one," "only one," "a sole," or "consisting of one."

Selection of Elements.

It is to be further understood that claim terminology relating to elements A, B, and C recited as "one of A, B, and C" is intended to cover devices or processes having one or more of element A, or one or more of element B, or one or more of element C, and does not require the presence of three of such elements A, B, and C nor exclude coverage of devices or processes including the presence of three of such elements A, B, and C. Likewise, recitation of "at least one of A, B, and C" is to be given the same interpretation. On the other hand, if it is intended to limit coverage of a claim to devices or processes including one of each of a set of elements, the phraseology "one of each of A, B, and C" or "at least one of each of A, B, and C" is used. Still further, use of "or" in place of "and" in the above phrases is not intended to alter the meanings indicated above.

Quantities and Proportions.

For the purposes of this specification and appended claims, unless otherwise indicated, all numbers expressing quantities of ingredients, percentages or proportions of materials, reaction conditions, and other numerical values used in the specification and claims, are to be understood as being modified in all instances by the term "about." Accordingly, unless indicated to the contrary, the numerical parameters set forth in the following specification and attached claims are approximations that may vary depending upon the desired properties sought to be obtained by the embodiments of the present disclosure. At the very least, and not as an attempt to limit interpretation or the application of the doctrine of equivalents to the scope of the claims, each numerical parameter should at least be construed in light of the number of significant digits and by applying ordinary rounding techniques.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements.

Ranges Intended to Disclose Sub-Ranges.

Moreover, all ranges disclosed herein are to be understood to encompass any and all sub-ranges subsumed therein. For example, a range of "1 to 10" includes any and all sub-ranges between (and including) the minimum value of 1 and the maximum value of 10, that is, any and all sub-ranges having a minimum value of equal to or greater than 1 and a maximum value of equal to or less than 10, e.g., 5.5 to 10.

Negative Limitations Intended.

The following description and related drawings are to be understood to positively disclose structure having direct connection of elements, i.e., without an intervening element or elements, where elements are so shown and/or so described as connected, but are not to be interpreted as requiring exclusion of intervening elements, unless explicitly stated, regardless of whether such intervening elements are shown, stated, or claimed. Likewise with regard to compositions, the following description and related drawings are to be understood to positively disclose compositions without substances or elements other than so described and/or shown, but are not to be interpreted as requiring exclusion of other substances or elements, unless explicitly stated, regardless of whether such additional substances or elements are shown, stated, or claimed. Similarly, the following description and related drawings are to be understood to positively disclose processes having directly following operations or steps, i.e., without an intervening operations or steps, where operations or steps are so shown and/or so described as directly following one another, but are not to be interpreted as requiring exclusion of intervening operations or steps, unless explicitly stated or claimed, regardless of whether such intervening operations or steps are shown, stated, or claimed.

Feature Interchange and Transfer Implicit

Various embodiments of the present invention are disclosed herein each having features associated with the particular embodiment. It is to be understood that unless functionally precluded, features of a first embodiment are considered to be disclosed as interchangeable with features of a second embodiment where similar functions are performed, or includable in a second embodiment where an equivalent feature is not explicitly disclosed. For example, if a first embodiment includes a first type of fastener, and a second embodiment includes a second type a fastener performing a like function, it is considered implicitly disclosed that the first embodiment may also employ the second type fastener and vice versa. Similarly, if the second embodiment lacked a corresponding second type fastener, but functioning of the first type fastener in the second embodiment is not structurally or operably precluded, it is to be understood that the first type fastener is applicable and transferable to the second embodiment.

A. Overview.

Referring to FIGS. 1*a*-1*d*, there is shown an embodiment of a shelf unit 10 having a support shroud 12 and a shelf 14. The support shroud 12 is comprised of a shroud front wall 16 and shroud side walls 18*a* and 18*b*. The support shroud 12 is shown optionally having a trapezoidal shape with a shroud top width D1*w* and a shroud top depth D1*d*, tapering down to a shroud bottom exterior width D3*e*, shroud bottom interior width D3*i*, a shroud bottom exterior depth D6*e* and shroud bottom interior depth D6*i*. The support shroud 12 has a shroud height D2. At a bottom of the shroud 12, the shroud front wall 16 and the shroud side walls 18*a* and 18*b* define a first shroud bottom aperture 19-1 having the dimensions D3*i* and D6*i*. When installed on a building wall 26, the first shroud bottom aperture 19-1 is fully defined on all sides.

On the shelf 14 is disposed, for the purpose of explanation, an electronic device 22 which is optionally any of, a Bluetooth speaker, a radio, a display, a lamp, a television, or another type device which requires a hard wire or optical fiber connection for either power or communication. The support shroud 12 is situated over a wall outlet 24, mounted the building wall 26, and disposed above a floor 27. The electronic device 22 is connected to the wall outlet 24 via a plug unit 28 and a cord 29. As shown by broken lines, the wall outlet 24, the plug unit 28, and the cord 29 are behind the front wall 16 of the support shroud 12 and are thus protected and concealed. Concealing the wall outlet 24, besides aesthetically enhancing the apparent of an installation of the shelf unit 10, provides the safety feature of not attracting the attention of small children. While the cord 29 is shown extended, it is to be understood that it may be coiled within the support shroud 12 as its length may dictate necessary. Furthermore, while the present example illustrates a power connection, as discussed further herein the wall outlet 24 may also provide for a communication connection to, for example and not limitation, a cable television female F connector, an ethernet connector, an optical connector, a USB connector (for power and/or communication), or any other type of connection which may be required by a device disposed on the shelf 14

For simplicity, the wall outlet 24 is depicted based on its external appearance comprising a faceplate installed over a dual receptacle outlet which, in turn, is mounted in an outlet box (not shown in FIGS. 1*a*-1*d*, see FIG. 4*a*). The dimensioning of the faceplate is pertinent to the support shroud construction. The outlet box is generally installed in new construction fastened to a wall stud and is typically 2" by 3" for a one gang outlet. A two gang outlet box is typically 4" by 3" and a further feature of the present disclosure, discussed below, includes the support shroud 12 being dimensioned to accommodate installation over a two gang box. The Americans with Disabilities Act (ADA) stipulates that a bottom of an outlet box be a minimum of 15" above the floor 27, but this is not mandatory in residential construction and typical installations are in the range of 12" to 16" above the floor 27. In FIG. 1*a*, the outlet box is situated at box height D4 above the floor 27 with the box height D4 extending higher than a bottom edge of the wall outlet 24 because the faceplate extends beyond a perimeter of the outlet box.

The shelf 14 has a top surface at a shelf height D5*s* above the floor 27 as shown in FIG. 1*a*. While any desired height may be achieved by increasing or decreasing the shroud height D2, there are ranges of height which are ergonomically dictated by an application. For example and not limitation, a standing work table has a height in the range of about 34" to about 46", with the height being preferably matched to a person using the table. Another example is a desk height range which is about 28" to about 30". Still another example is a coffee table height range which is about 16" to 18".

Figure 1D:
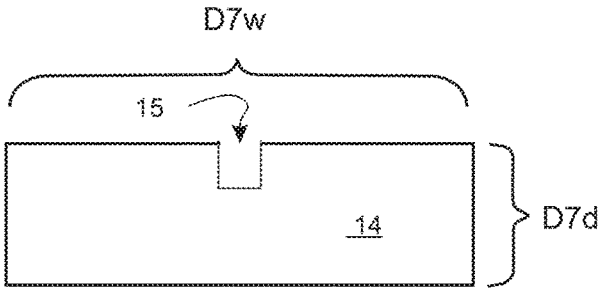
FIG. 1*d* is a top plan view of a shelf of the self unit of FIG. 1*a;*
Figure 1C:
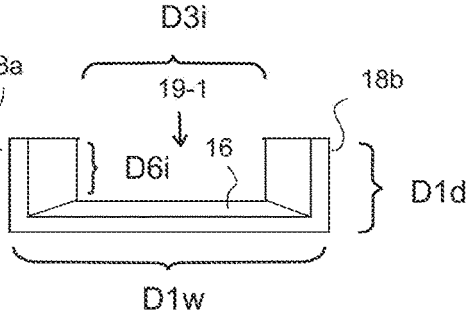
FIG. 1*c* is a top plan view of a support shroud of the wall unit of FIG. 1*a* absent a shelf.
Figure 1B:
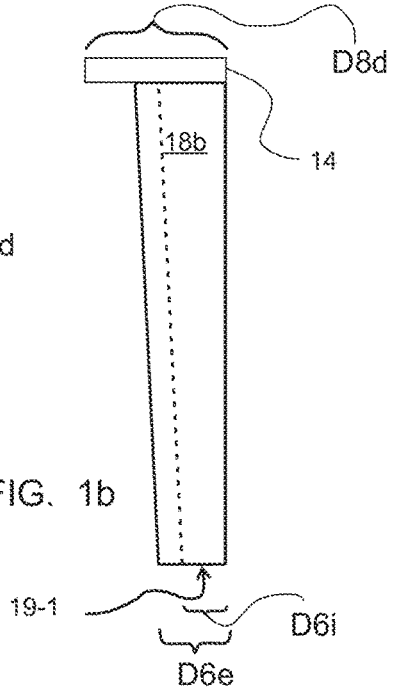
FIG. 1*b* is a left side elevation view of the shelf unit of FIG. 1*a;*

Referring to FIGS. 1*b*-1*c*, a side elevation and plan view (without shelf 14) of the support shroud 12 shows that it is optionally configured to slant outward from the wall 26 with increasing distance from the floor 27. The support shroud 12 is selectively dimensioned to accommodate a range of common electric outlet mounting heights with the example shown in FIG. 1*b* having the wall outlet 24 mounted an outlet box height D4 above the floor 27. The front wall bottom edge 16*a* is optionally positioned a bottom height D5*b* above the floor and at an inch below the bottom of the wall outlet 24 so as to conceal the wall outlet 24. Alternatively, the front wall bottom edge 16*a* is optionally position level with the bottom of the wall outlet 24 or slightly above it as persons in a room containing the installation will be viewing the support shroud 12 at an angle from above the wall outlet 24 and a line of sight will extend to the building wall 26 to a point below the front wall bottom edge 16*a* thus concealing the wall outlet 24. A typical one gang faceplate of a one gang wall outlet has a width of 2.75" so a shroud bottom interior width D3*i* is selected to allow clearance for the one gang plate, optionally a ¼" clearance on both sides of the front plate yielding a nominal shroud bottom interior width D3*i* of 3¼". A typical two gang faceplate has about a 4.75" width yielding a nominal shroud bottom interior width D3*i* of about 5¼".

The exterior dimensions referred to herein are dependent upon construction material of the support shroud 12 which affects feasible wall thicknesses, variations in the outlet height D4, and a desired shelf height D5. If the support shroud 12 is constructed of ¾ inch thick wood board the shroud bottom exterior width D3*e* is nominally 4¾" yielding a shroud bottom interior width D3*i* to be 3¼". The thickness of the shroud side walls 18*a* and 18*b* may be decreased as load requirements and material strength of the shroud side walls 18*a* and 18*b* and the front wall 16 permit. Wood is optionally used because it provides an aesthetically pleasing appearance when finished properly. Other materials including plastics, resin impregnated fiberglass, and metals are optionally used to reduce wall thickness and provide for weatherability (exterior applications), weight reduction (reduced shipping costs), and economy. For upscale variants, stone material is optionally used where it coordinates with other materials of the building or the self unit 10 is intended for an exterior installation. The foregoing lists of materials does not constitute an exclusive catalog of construction material of the shelf unit 10, are exemplary in nature, and are not limitations upon materials to be used.

Referring to FIGS. 1*b* and 1*c*, the dimensioning of a bottom of the support shroud 12 is shown wherein the interior dimensions are illustrated, in particular, the shroud bottom interior width D3*i* and the shroud bottom interior depth D6*i*. In order to accommodate a plug unit 28, the shroud bottom interior depth D6*i* is optionally 2¼" to allow clearance for the plug unit 28. Some plug units incorporate an AC to DC convertor, hereinafter referred to as an AC adaptor, and are larger than typical electrical plugs on extension cords for instance which are typical about 1¾" when the bend of the cord is taken into account. An AC adaptor typically has a cubical shaped housing with a depth of about 2" with the conductor prongs extending a further ⅝'. Hence, when inserted into the wall outlet 24 the plug unit housing extends out about 2" which is cleared by the 2¼" shroud bottom interior depth D6*i*. Further dimensioning considerations are discussed below.

Referring to FIG. 1*d*, a top plan view of the shelf 14 is shown. The shelf 14 has a shelf width D7*w* and a shelf depth D7*d*. The shelf 14 has an shelf aperture 15 through which the cord 29 passes. At a minimum, the shelf aperture 15 is sized to accommodate passage of a two prong electrical plug which is typically about 1" by ¾".

B. Mounting Configurations.

Referring to FIGS. 2*a*-2*d*, there are shown optional mounting features of the present disclosure comprising configurations for attaching the shroud support 12 to the building wall 26. In a view from a rear side of the support shroud 10 of FIG. 2*a*, there is a French cleat 30 comprising an upper French cleat cross member 30*a* bridging and fixed to the right and left shroud side walls, 18*a* and 18*b*, and a lower French cleat member 30*b*. The upper French cleat cross member 30*a* is configured to engage the lower French cleat member 30*b* as shown in FIG. 2*c*. The lower French cleat member 30*b* is mounted to the building wall (not shown) using any form of anchoring method dictated by the building wall construction, for example and not limitation: screws, nails, adhesive, toggle bolts, lead anchors and lag bolts, or any of a variety of dry wall anchors.

As shown in the sectional view of FIG. 2*c*, the French cleat members, 30*a* and 30*b*, each have a slanted side which engage one another to mount the support shroud 12 to the building wall. Once the lower French cleat member 30*b* is affixed to the building wall the support shroud 12 is lowered to engage the upper French cleat cross member 30*a* with the lower French cleat member 30*b*. This mounting arrangement allows the shelf unit 10 to be easily disengaged from the building wall to allow clear access to the wall outlet 24. The access permits plugging the plug unit 28 of the electronic device 22 into the wall outlet 24, as shown in FIG. 1*a*, followed by engaging the shelf unit 10 to the building wall 26 with the electronic device 22 functionally connected as shown in FIG. 1*a*. Furthermore, the French cleat configuration allows the shelf unit 10 to be adjustably positioned in the horizontal direction facilitating alignment with the wall outlet 24.

A lower portion of the support shroud 12 is optionally connected to the building wall by a cross member 32*a* at a lower portion of the support shroud 12. The cross member

32*a* is arranged to coincide with the wall outlet 24 as shown in the sectional view of FIG. 2*c*. The cross member 32*a* has an elongated hole 33*a* through which a screw 33-1 is passed and screwed into a face plate mounting threaded hole of the wall unit 24 in place of an original screw to secure the lower portion of the support shroud 12. The elongated hole 33 allows for vertical leeway when mounting the support shroud 12 to building wall while the French cleat, 30*a* and 30*b*, allows horizontal alignment.

Referring to FIG. 2*d*, in a rear view of the support shroud 12 there is shown a mounting plate 32*b* which is fixed to the support shroud 12 as an alternative to the cross member 32*a*. The mounting plate 32*b* has elongated holes 33*a* through which screws are used to attach the mounting plate 32*b* to the wall unit 24 in place of a faceplate of the wall unit. The mounting plate 32*b* has an oversized receptacle aperture 33*b* which is larger than standard receptacle rectangles and allows for at vertical displacement relative the wall outlet in conjunction with the elongated holes 33*a*. As discussed above, the support shroud mounting is facilitated by the horizontal adjustability of the French cleat 30 and vertically leeway provided by the elongated holes 33*a*. Furthermore, it is to be understood that the adjustability directions may be interchanged with a French cleat configuration at the wall unit 24 and the cross member 32*a* disposed above for a screw connection into the building wall 24.

Referring to FIGS. 3*a*-3*g*, further mounting features of the present disclosure are shown including a wall cleat arrangement for mounting the shelf unit 10. A wall cleat 34, shown in exploded views in FIGS. 3*c* and 3*d*, is derivative of the French cleat 30, also sometimes referred to as a French cleat, and generally consists of an upper wall cleat member 34*a* and a lower wall cleat member 34*b*, typically of metal construction, configured to interlock in a manner similar to the French cleat 30. A cross member 32 is fixed bridging the right and left shroud side walls, 18*a* and 18*b*, and has the upper wall cleat member 34*a* affixed to a rear side as shown in FIG. 3*a*. The cross member 32 is optionally positioned recessed from rear edges of the right and left shroud side walls, 18*a* and 18*b*, as shown in the top plan view of FIG. 3*b*, to allow clearance for a thickness of the upper wall cleat member 34*a*. The upper wall cleat member 34*a* is thus optionally disposed about flush with the rear edges of the support shroud 12 and accordingly situates the support shroud 12 against the building wall 26 when engaged with the lower wall cleat member 34*b* mounted to the building wall 26. As shown in FIGS. 3*c* and 3*d*, edges of the upper and lower wall cleat members, 34*a* and 34*b*, are configured to engage one another when the members are brought together. The wall cleat 34 provides advantages similar to the above discussed French cleat 30 and may be employed in any embodiment of the support shroud 12 disclosed herein.

Referring again to FIG. 3*a*, at a lower portion of the support shroud 12 the provided a cross member 32-1 having a hook 35*a*. The hook construction of the hook 35*a* is shown in side view in FIG. 3*e*. The hook 35*a* is adapted to engage with an eye plate 35*b*, shown in FIGS. 3*f* and 3*g*, which is configured to replace a faceplate of a wall outlet. The eye plate 35*b* defines an eye notch 35*c* into which the hook 35*a* is engage. The eye notch 35*c* and hook 35*a* are preferably designed to provide vertical leeway in their engagement range to facilitate mounting the support shroud 12.

Referring to FIGS. 4*a* and 4*b*, a further mounting feature of the present disclosure is illustrated which is optionally directed to dry wall installations. When installing the shelf unit 10 onto a wall comprised of sheet rock mounted on wall studs, one optionally mounts the support shroud 12 to a wall stud 42 behind the sheet rock (not shown). Generally, an outlet box 40 is fastened to the stud 42 whose proximity to the outlet box 40 renders it advantageous for mounting the shelf unit 10 to the wall stud 42 for improved support. While the aforesaid mounting configurations of FIGS. 2*a*-3*d* are optionally, but not exclusively employed, to mounting absent stud availability, said configurations may also be employed to mounting the support shroud 12 on a wall stud 42 wherein one of the anchoring devices is a screw, lag bolt, or nail fastening the respective cleat member to the stud 42 while another anchoring device of the cleat member is tailored to drywall mounting. The mounting arrangement of FIGS. 3*a*-3*d* may be employed in any embodiment of the support shroud disclosed herein.

Referring again to FIGS. 4*a*-4*c*, the cross member 32 has installed thereon an upper wall cleat plate 36*a* and a lower wall cleat L member 36*b* which is "L" shaped to provide a vertically extending arm to be fastened to the wall stud 42 optionally using at least two screws as depicted or other type of fastener providing sufficient holding strength. Edges of the upper wall cleat plate 36*a* and the lower wall cleat L member 36 are angled to engage one another as shown in FIGS. 4*b* and 4*c*. The wall cleat members 36*a* and 36*b* illustrate an alternative engagement configuration to that of the wall cleat members 34*a* and 34*b*, and such configurations are merely exemplary and maybe used interchangeably or another engagement configuration may be used which vertically secures the support shroud 12. While wall cleats (including French cleats) are advantageous in that they allow horizontal adjustment, other fastening devices may be employed to secure the support shroud 12. The support shroud 12 is disposed positioned such that the front wall bottom edge 16*a* is at the bottom height D5*b* above the floor 27 and conceals the wall outlet 24 (not shown) of the outlet box 40 which is mounted at the outlet box height D4 as discussed above. Again, the mounting arrangement of FIGS. 4*a*-4*c* may be employed in any embodiment of the support shroud disclosed herein.

Referring to FIG. 5, another mounting configuration is shown from a rear view of the support shroud 12 wherein a hanging wire 38 is fastened to opposing side walls, 18*a* and 18*b*, and is used to support the shelf unit 10 on a protrusion from the building wall 26, for example and not limitation, any one of a suitably mounted screw, nail, or picture hanging hook. The cross member 32 resists inward force of the hanging wire 38. Alternatively, the hanging wire 38 may be mounted to the cross member 32. Other hanging devices, such as plates with apertures for engaging the protrusion may be employed as are known to those skilled in the art.

The various mounting arrangements of the lower and upper portions of the support shroud 12 shown in FIGS. 2*a*-2*d*, FIGS. 3*a*-3*g*, FIGS. 4*a*-4*c*, and FIG. 5 are optionally provided in any combination thereof in any of the embodiments of the support shroud 12 disclosed herein. Generally, upper mounting arrangements described herein are hanging mounts which permit the support shroud to be placed onto a wall by downward displacement to engage a given mounting configuration. The lower mounting configurations are optionally provided and are also of a hanging mount variety but others related herein are secured by screws. While alternative mounting arrangements have been disclosed, it is to be understood that the present invention is not limited to those arrangements and that adaptions of other mounting configurations to mounting of the support shroud 12 are considered to be within the scope and spirit of the present invention.

C. Access Door Embodiments.

Figure 6A:
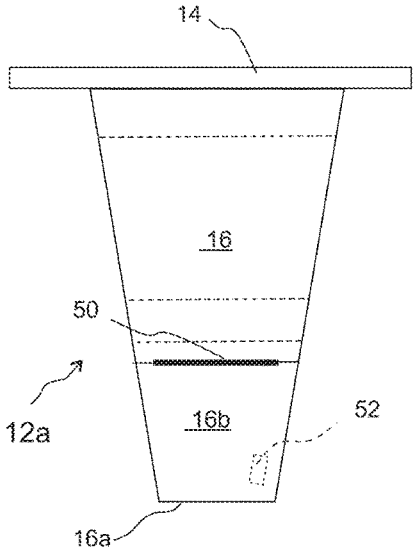
FIG. 6*a* is a front elevation view of an embodiment of the shelf unit of the present invention wherein a support shroud embodiment has an access door.
Figure 6B:
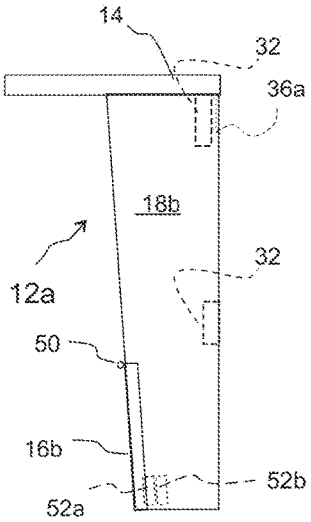
FIG. 6*b* is a left side elevation view of the shelf unit of FIG. 6*a;*
Figure 6C:
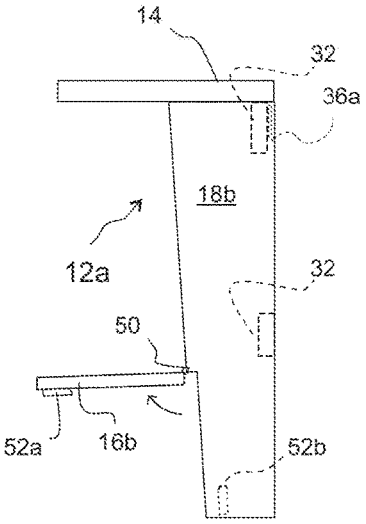
FIG. 6*c* is a left side elevation view of the shelf unit of FIG. 6*a* shown the access door in an open position.

Referring to FIGS. 6*a*-6*c*, a further embodiment of the present invention is shown wherein a support shroud 12*a* has an access door 16*b*, and this feature is optionally incorporated into any of configurations of the present invention described herein. The access door 16*b* is optionally provided in the shroud front wall 16 to allow access to the wall outlet 24 (not shown) concealed by the support shroud 12*a*. The access door 16*b* is mounted to the shroud front wall 16 optionally by a small piano hinge 50, sometimes referred to as a continuous hinge. The piano hinge 50 is merely exemplary of any other type of hinge, and use of any type hinge which functions to allow opening of the access door 16*b* is considered to be within the scope of the present invention. Such hinges include any visible or hidden type hinge that allows opening of the access door 16*b*. A retainer device 52, having parts 52*a* and 52*b*, is optionally disposed to secure the access door 16*b* in position when closed.

A further embodiment of the support shroud 12*a* includes the access door 16*b* being optionally pivotally mounted between extensions of the right and left shroud side walls, 18*a* and 18*b*. In this configuration the right and left side walls 18*a* and 18*b* extend forward to a surface level of the shroud front wall 16 and the access door pivots outward with pivots at a top side thereof. Other pivot arrangements are considered to be within the scope and spirit of the present invention.

In FIGS. 6*a*-6*b*, the hinge 50 is shown at a top edge of the access door 16*b*, however it is further considered to be within the purview of the present invention that the access door 16*b* is optionally hinged at either side to one of the shroud side walls, 18*a* and 18*b*. It is further within the scope of the present invention that dual access doors be provided, each being hinged or pivotally mounted to one of the sides walls 18*a* and 18*b*. The access door embodiments of FIGS. 6*a*-6*c* are direct to a an access door provided in a lower half of the support shroud 12*a*, a lower third, or a bottom quarter of the support shroud 12*a* so as to coincide with a wall outlet when the support shroud 12*a* is so mounted on a building wall. While in the above discussion the access door 16*b* is movably mounted to the support shroud 12*a*, it is further envisioned that the access door may be embodied as an access panel that is removably mounted as discussed below.

Figure 7A:
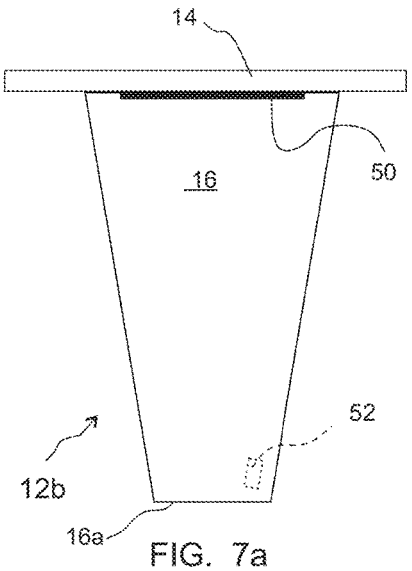
FIG. 7*a* is a front elevation view of another embodiment of the shelf unit of the present invention wherein a further support shroud embodiment has another access door configuration.
Figure 7B:
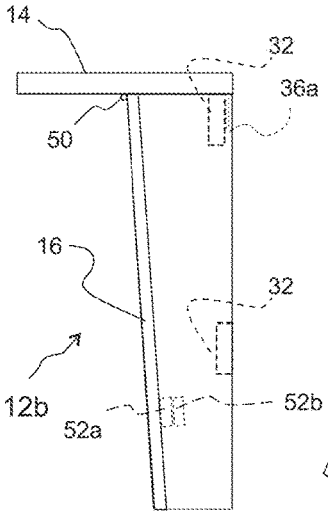
FIG. 7*b* is a left side elevation view of the shelf unit of FIG. 7*a;*
Figure 7C:
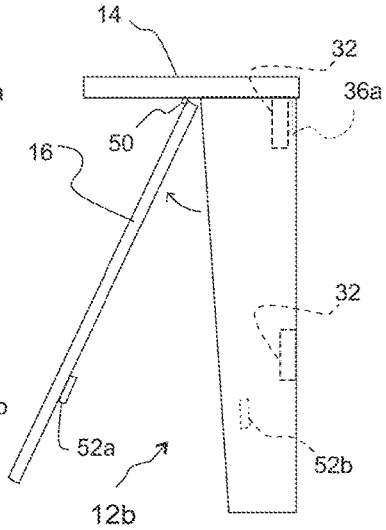
FIG. 7*c* is a left side elevation view of the shelf unit of FIG. 7*a* shown the access door in an open position.

Referring now to FIGS. 7*a*-7*b*, another embodiment of the present invention is shown wherein a support shroud 12*b* includes an access arrangement wherein the shroud front wall 16 that is hinged by the piano hinge 50 at a top edge to the shelf 14 to function as an access panel to an interior of the support shroud 12*b*. In this configuration, more than one cross member 32 is optionally used to ensure structurally integrity of the support shroud 12*b*. Again, the retainer device 52 is optionally employed or a self closing hinge may be used in place of the piano hinge 50. In a still further embodiment, an intermediate configuration included an access door or panel that extends downward from an upper half of the shroud front wall 16 and is removably or rotatably engaged with the support shroud 12*a*

The retaining device 52 described herein is comprised of the first retainer part 50*a* mounted to the access door 16*b* and the second retainer part 50*b* mounted to the left side wall 18*b*. The retaining device 50 may be any device functional to retain the access door 16*b* in a closed position, including for example and not limitation, a magnetic catch, spring roller (double or single) type catch, spring bullet type catch (when the access door 16*b* sits between opposing shroud side walls 18*a* and 18*b*), a velcro catch arrangement, or a spring loaded catch. Yet another closure method optionally used in any of the configurations described herein is an extension spring or a dashpot closer. In summary, any retaining device which maintains the access door 16*b* in a closed position is considered within the scope of this disclosure. It is to be further understood that it is within the scope of the present invention to omit the retaining device 50 and use a self closing hinge in place of the piano hinge 50.

With regard to FIGS. 6*a*-7*b*, cross members 32 are shown at a rear side of the support shrouds 12*a* and 12*b*. Provision of one or more cross members 30 is optional and depends on the wall mounting method employed, and a strength of the support shroud 12 absent such members. For example, the support shroud 12, while illustrated as having side walls 18*a* and 18*b* and a front wall 14, is optionally formed of a material molded to provide for sufficient rigidity absent cross members 32. In general, one or more of the cross members 30 are optionally incorporated into any of the embodiments of the shelf support described herein.

A further feature of the present invention, which may be applied to any of the embodiments described herein, provides that the access door 16*b* of the front wall 16 does not hinge or pivot but is removably mounted. This feature optionally includes using any of the above noted retaining devices or any other type of retaining device that suffices to allow engagement and disengagement of the access door 16*b* with the support shroud 12.

It will be further appreciated from this disclosure that although the piano hinge 50 of FIGS. 6*a*-6*c* is located in a lower area of the shroud front wall 16, it may be located higher up the shroud front wall 16 with the highest positioning of the piano hinge 50 being that of FIGS. 7*a*-7*b* wherein the entire shroud front wall 16 is hinged from the shelf 14. In a further variation of this configuration (not shown), the shroud front wall 16 is optionally situated between opposing ones of the right and left shroud side walls, 18*a* and 18*b*, and is pivoted from the side walls without hinging to the shelf 14. Yet another configurations provides the front wall 16 being split to form two access doors each being hinged or pivotally mounted to respective ones of the side walls 18*a* and 18*b*.

D. Alternative Shroud and Shelf Configurations.

D1. Dual Shroud Embodiment.

Figure 8A:
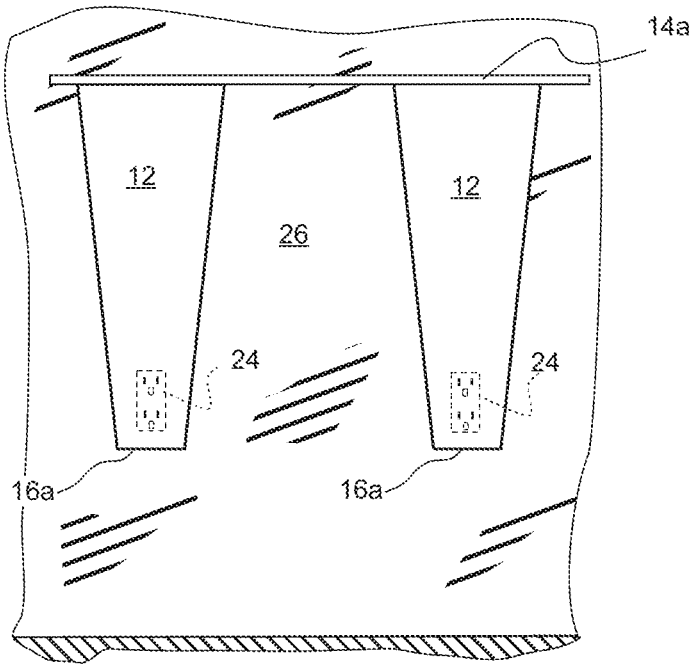
FIG. 8*a* is a front elevation view of yet another embodiment of a shelf unit of the present invention installed on a building wall and having two support shrouds optionally installed over one or two wall units and having an elongated shelf.

Referring to FIG. 8*a*, a further embodiment of the present invention is shown wherein first and second support shrouds 12 are mounted to the building wall 26 by any of the mounting configurations related herein. An elongated shelf 14*a* is supported by the first and second support shrouds 12. While support shroud 12 is shown, any of the embodiments of the support shroud 12 described herein may be used. The support shrouds 12 are optionally mounted to cover one or more of the wall outlet 24 by any of the mounting configurations described herein. The elongated shelf 14*a* includes the shelf aperture 15 (not shown, see FIG. 1*d*) above one or both of the supports shrouds 12. If only one of the wall outlet 24 is used then it may be necessary to extend access to either of power or communication across the elongated shelf 14*a*. Cabling may simply lay atop the elongated shelf 14*a*, to extend to various device, alternatively further embodiments are shown in FIGS. 8*b* and 8*c* and are discussed below.

D2. Connection Strip.

Figure 8B:
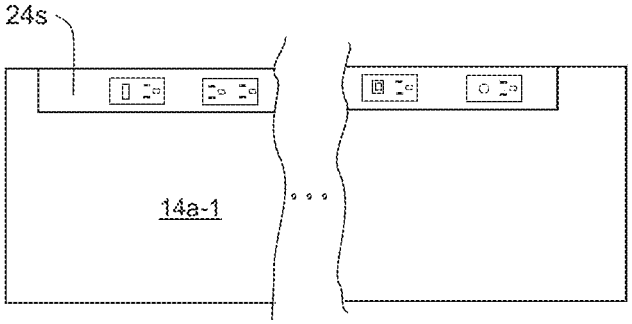
FIG. 8*b* is a top plan view of an embodiment of the elongated shelf of the shelf unit shown in FIG. 8*a;*
Figure 8C:
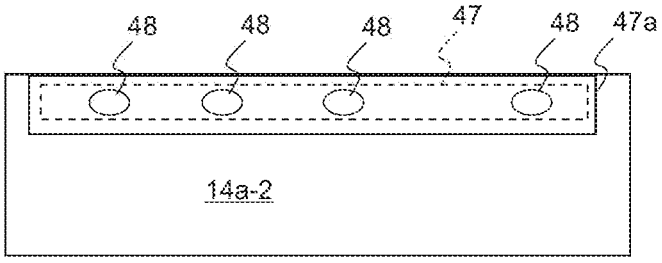
FIG. 8*c* is a top plan view of another embodiment of the elongated shelf of the shelf unit shown in FIG. 8*a;*

An optional feature of the present invention is shown in FIG. 8*b*, the feature being the incorporation of a connection strip 46 into or onto a shelf 14*b* with cables connecting it to various types of connections of the wall outlet 24 via one or more of the shelf aperture 15 and one or more of the support shroud 12. The connection strip 46 is optionally either carried on top of the shelf 14*a* or is sunk into the shelf 14*a*.

The connection strip includes one or more of the various types of outlets discussed herein D3. Conduit Shelf.

Referring now to FIG. 8*c*, another embodiment provides a conduit shelf 14*b* which includes a trough 47 having a trough cover 47*s* in which cover apertures 48 are defined for the passage of wires and cable from electronic devices. The trough 47 includes one or more openings into one or more of the support shrouds 12 permitting cable connection to the wall outlet 24. The trough cover 47 is optionally removably disposed to cover the trough 47 and facilitate manipulation of connections. While the conduit shelf 14*a*-2 includes the trough 47 allowing passage of cable, other conduit configurations may be incorporated into or onto the elongated conduit shelf 14*a*-2, such as a wiring conduit attached to a bottom or top of the elongated conduit shelf 14, or incorporated therein. Any of the connection access shelf 14*a*-1 or the conduit shelf 14-2 is optionally incorporated into any invention embodiment described herein.

D4. Two Gang Outlet and Varied Connections.

Figure 8D:
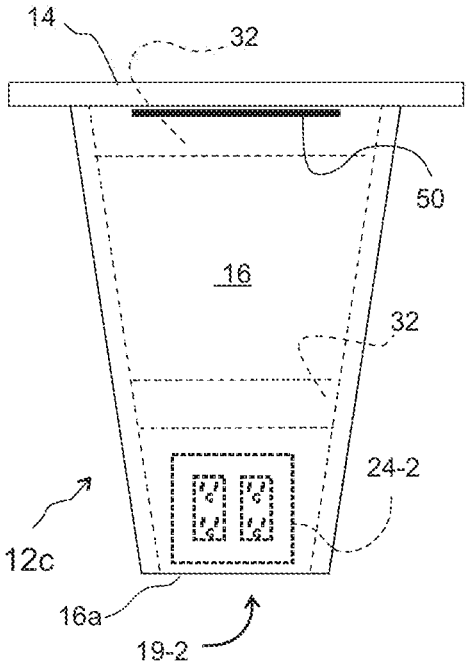
FIG. 8*d* is a front elevation view of yet another embodiment of the shelf unit of the presenting shown mounted over a two gang outlet.

Referring now to FIG. 8*d*, a further embodiment of the present invention is shown wherein a support shroud 12*c* is configured to be installed over a two gang outlet 24-2. In the embodiment shown, the support shroud 12*c* has the front wall 16 connected to the shelf 14 via the hinge 50, thus serving as an access door to the two gang outlet. Nevertheless, any of the support shroud configurations described herein my be used provided the shroud is dimensioned to conceal the two gang outlet 24-2. Preferably, when an access door is not incorporated, a second shroud bottom aperture 19-2 (similarly defined as the first shroud bottom aperture 19-1) of the support shroud 12*c* is dimensioned to permit manual access to the two gang outlet 24-2.

Figure 9A:
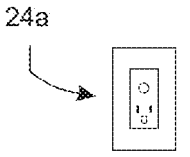
FIG. 9*a* is a front view of a wall outlet including a power receptacle and an F-connector.
Figure 9B:
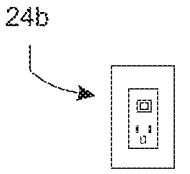
FIG. 9*b* is a front view of a wall outlet including a power receptacle and an ethernet or telephone connector.
Figure 9C:
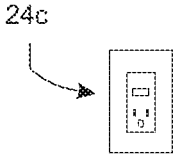
FIG. 9*c* is a front view of a wall outlet including a power receptacle and a USB connector.

FIGS. 9*a*-9*c* illustrate various types of connections a wall outlet optionally provides wherein FIG. 9*a* shows a wall outlet 24*a* with a power and F cable receptacle, FIG. 9*b* shows a wall outlet 24*b* with a power and an ethernet receptacle or telephone receptacle, and FIG. 9*c* shows a wall outlet 24*c* with a power and USB cable receptacle. The listed connection types are exemplary and not exclusive as other types of power or communication connections exist, or will exist, and are considered within the scope of the present invention.

D5. Outlet Equipped Support Shrouds.

Figure 10A:
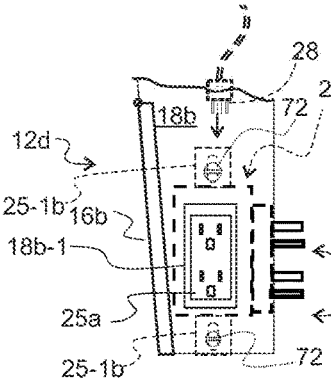
FIG. 10*a* is a left side elevation partial view of another embodiment of a support shroud of the present invention incorporating an outlet adaptor providing power receptacles in a left side of the support shroud and internal to the support shroud providing power receptacles for devices to be carried on a shelf (not shown) carried on the support shroud.
Figure 10B:
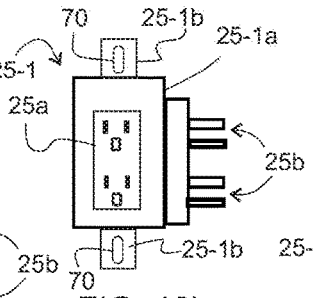
FIG. 10*b* is a front side elevation view of the outlet adaptor of FIG. 10*a;*
Figure 10C:
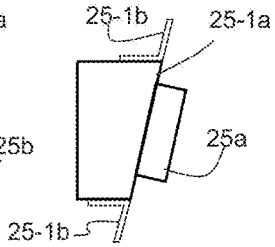
FIG. 10*c* is a right said elevation view of the outlet adaptor of FIG. 10*a;*
Figure 10D:
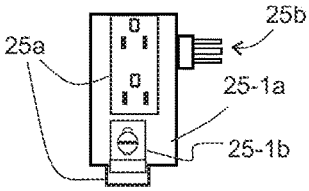
FIG. 10*d* is a top plane view of the outlet adaptor of FIG. 10*a* showing power receptacles in a top side of the outlet adaptor.

Referring to FIGS. 10*a*-10*c*, in a further embodiment of the present invention, an outlet equipped support shroud 12*d* has a outlet adaptor 25-1 installed in the left side wall 18*b*. The outlet adaptor 25-1 comprises an adaptor body 25-1*a* having first outlet receptacle 25*a* in a side thereof as shown in FIGS. 10*a* and 10*b*, and an optional second outlet receptacle at a top surface thereof as shown in FIG. 10*d*. At a rear side of the adaptor body 25-1*a* there extends at least one power plug 25*b* (two are shown) for insertion into the wall outlet 24. The side outlet receptacle 25*a* extends from the adaptor body 25-1*a* and through an opening 18*b*-1 in the left side wall 18*b*. A remainder of the outlet adaptor 25 is concealed within the outlet equipped support shroud 12*d*.

The outlet equipped support shroud 12*d* is preferably mounted on the building wall 26 using one of the aforesaid cleat configurations which permit horizontal adjustment. A vertical distance required between the wall outlet 24 and a wall mounted cleat for alignment of the power plug 25*a* may be difficult to accurately execute. In view of this, the outlet adaptor 25-1 optionally mounts in the first outlet equipped support shroud 12*d* via floating mount effected by mounting ears 25-1*b* which have elongated slots 70 for receiving mounting screws 72 and allowing vertical displacement of the outlet adaptor 25-1 relative to the outlet equipped support shroud 12*d* to compensate for minor vertical misalignment. The opening 18*b*-1 is dimensioned to allow displacement of the outlet adaptor 25-1. Other mounting configurations maybe utilized and are considered to be within the scope and spirit of the present disclosure.

As shown in FIG. 10*d*, the adaptor body 25-1*a* optionally is provided with the second outlet receptacle 25*a* into which, as shown in FIG. 10*a*, a plug unit 28 from an electronic device on the shelf 14 (not shown) is inserted. In this embodiment the outlet equipped support shroud 12*d* has the access door 16*b* situated to allow access to the top surface of the adaptor body 25-1*a* so the plug unit 28 may be manually inserted. Alternative access door configurations described herein are optionally implemented in the outlet equipped support shroud 12*d* or the hinged shelf configuration may implemented. The second outlet receptacle 25*a* is optional because, as related above, the outlet adaptor 25-1 may have only a single power plug 25*b* which would leave open a receptacle in the wall outlet 24 for connection of the plug unit 28 in the wall outlet.

Figure 11:
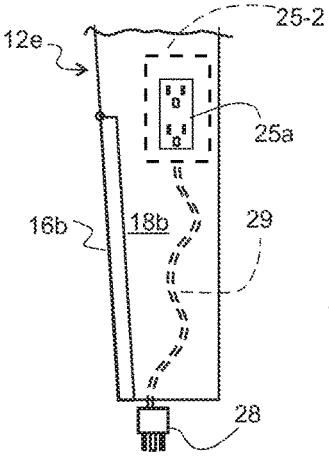
FIG. 11 is a left side elevation view of an embodiment of a support shroud having another embodiment of an outlet adaptor in a side thereof, which outlet adaptor connects to a wall outlet via a cord and plug.

Referring now to FIG. 11, there is shown another embodiment comprising an second outlet equipped support shroud 12*e* including an outlet adaptor 25-2 which is mounted in the left side wall 18*b* and has an outlet receptacle 25*a* extending through an opening in the left side wall 18*b*. The outlet adaptor 25-2 has a power cord 29 and plug unit 28 which extends a distance downward for insertion into a wall outlet 24. The outlet adaptor 25-2 is optionally mounted using ears as described above or other mounting configurations which need not provide a floating mount.

Both the first and second outlet equipped support shrouds, 12*d* and 12*e*, allow for an external outlet connection to be made for appliances which, on occasion, require line power. The outlet receptacle 25*a* is depicted disposed on a side of the shroud which removes it from a field of view of those facing the wall 26 from a perpendicular direction and thus the curiosity of young children. However, the outlet receptacle 25*a* may also be disposed on the shroud front wall 16.

D6. Outlet Mounted Support Shroud.

Figure 12A:
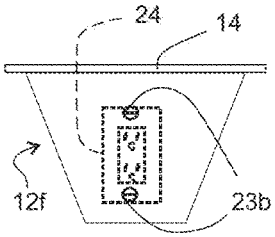
FIG. 12*a* is a front side elevation view of another embodiment of a support shroud configured for mounting on an elevated wall outlet such as over a counter top.
Figure 12B:
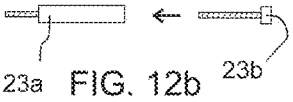
FIG. 12*b* is a side view of a threaded standoff and screw used in mounting the support shroud of FIG. 12*a;*

Now referring to FIGS. 12*a* and 12*b*, another embodiment is shown having a short support shroud 12*f* carrying the shelf 14. This embodiment is adapted to applications where the wall outlet 24 is disposed at a high position, such as in a kitchen or bathroom where it may be situated above a counter top. The reduced size of this embodiment allows mounting directly to the wall outlet 24. Present day wall outlets have a faceplate attached thereto by screws at center top and center bottom positions. In order that the faceplate may remain installed, the short support shroud 12*f* further includes two standoff and screw combinations each comprising a threaded stud and standoff 23*a* and a standoff threaded screw 23*b* which threads in an end of the threaded stud and standoff 23*a*. Thus, installation comprises removing screws of the faceplate and replacing them by screwing in one of the threaded stud and standoffs 23*a*. Next the short support shroud 12*f* is mounted using the standoff threaded screws 23*b* which are passed through a front wall of the short support shroud 12*f* when positioned over the wall outlet 24 and into threaded ends of the previously installed threaded stud and standoffs 23*a*. The shroud height D2 (see FIG. 1*a*) of this embodiment is optionally in the range of about 4½ inches to about 12 inches. Alternatively, the faceplate is optionally omitted and the short support shroud 12*f* is installed using long screws which screw into threaded faceplate mounting holes of the outlet.

D7. Speaker Adapted Support Shroud.

Figure 13:
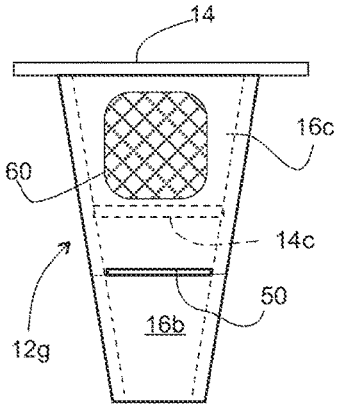
FIG. 13 is front side elevation view of another embodiment of a shelf unit incorporating an internal shelf and an acoustically transparent grill.

Another embodiment of the present invention is shown in FIG. 13 wherein a speaker adapted support shroud 12*g* has an internal shelf 14*c* installed and an acoustically transparent grill 60 in a front wall 16*c* thereof. This embodiment is adapted to supporting a display on the shelf 114 while supporting a speaker inside the speaker adapted support shroud 12*g* on the internal shelf 14*c*. The embodiment depicted optionally includes the access door 16*b* mounted on the piano hinge 50 at a lower half of the support shroud 12*g*. Alternatively, an access door 16*b* may be hinged on the front wall 16 at an upper position above the acoustically transparent grill 60 to allow access to a speak contained therein. Where the access door 16*b* is hinged below the internal shelf 14*c*, the shelf 14 is displaceably mounted to allow access to an area of the internal shelf 14*c*.

D8. Alternative Support Shroud Shapes.

Figure 14A:
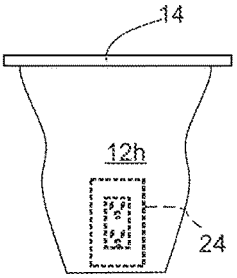
FIG. 14*a* is a front side elevation view of another embodiment of the shelf unit showing an alternative shape option.
Figure 14B:
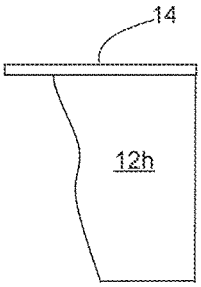
FIG. 14*b* is a left side elevation view of the shelf unit of FIG. 14*a;*

The above embodiments of the support shroud have a generally trapezoidal configuration. It is to be understood that this shape merely exemplary and other configurations may be employed. Referring to FIGS. 14*a* and 14*b*, there is shown a curved support shroud 12*h* wherein there sides taper in and are formed with curvatures. While three curved sides are used in FIGS. 14*a* and 14*b*, the curved support shroud 12*h* may also be embodied in a half cylinder form where the cylinder side is curved along an axial direction. Furthermore, a general shape of the support shroud need not taper but may have straight parallel sides, elliptical sides, or other forms.

D9. Rectangular Dual Shelf Support Shroud.

Figure 15A:
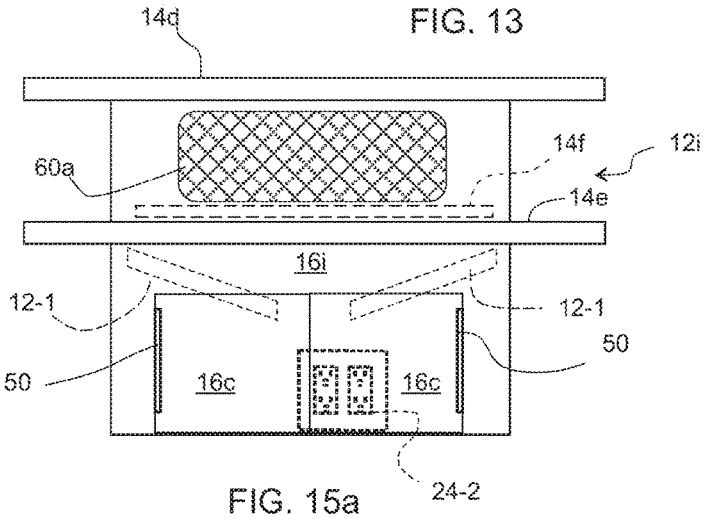
FIG. 15*a* is a front side elevation view of still another embodiment of the shelf unit having an internal shelf, an acoustically transparent grill, internal slanted walls, dual access doors, and a rectangular shroud shape option.
Figure 15B:
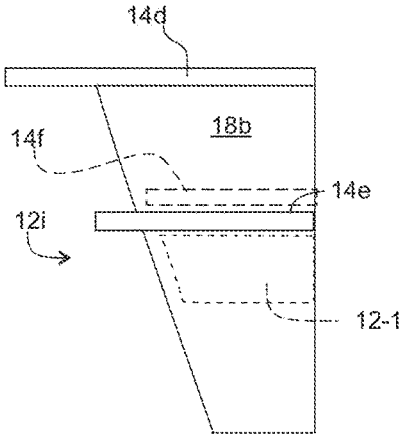
FIG. 15*b* is a left side elevation view of the shelf unit of FIG. 15*a;*

Referring to FIGS. 15*a* and 15*b*, yet another embodiment is shown wherein a rectangular support shroud 12*i* has a rectangular front wall 16*i* incorporating access doors 16*c* support on hinges 50. In the embodiment shown the rectangular support shroud 12 defines an opening in which an acoustically transparent grill 60*a* is disposed. An interior shelf 14*f* is provided upon which a speaker may be carried to project sound through the acoustically transparent grill 60*a*. The interior shelf 14*f* has an interior shelf aperture permitting cables to pass through to the wall outlet 24-2 as does a top shelf 14*d*. The top shelf 14*d* is supported on the rectangular shroud 12*i* and is optionally used to support an electronic device, for example and not limitation, a display operated in conjunction with the speaker. Still further, there is optionally provided a lower shelf 14*e* which extends outward from sides of the rectangular support shroud 12*i* and may be used to support right and left speakers. Apertures (not shown) are optionally provided in the right and left side walls, 18*a* and 18*b*, for passage of cabling. While shown having a rectangular configuration, other configuration shapes may be employed.

In order to retain an excess length of cabling within the support shroud 12*i*, interior inclined walls 12-1 are optionally provided and serve to funnel and retain cabling while allowing connection ends to be connected to the wall outlet 24-2. It is further within the scope of the present invention to optionally provide any of an interior hook, cleat, clip, clamp, or pocket, in place of or in addition to the interior inclined walls 12-1, as a means to retain cabling within the support shroud 12*i* or any of the embodiments of a support shroud disclosed herein.

E. Shelf Mounting Configurations.

In the preceding embodiments including various features, mounting of the shelf 14, or variations thereof, to one or more of the support shroud 12, is omitted from the discussion for the purpose of clarity. Shelf mounting methods and constructions are now discussed below and are each submitted as being applicable to any and all of the above embodiments of the shelf unit. Generally, the shelf mounting configuration may be either fixed or removable depending upon a desired operation of a given embodiment of the shelf unit 10. For the purpose of brevity, reference will be made to embodiments of FIG. 1*a*-1*d* with the understanding that configurations shown and described are applicable to each embodiment of the shelf unit described herein.

E1. First Removable Shelf Embodiment.

Figure 16A:
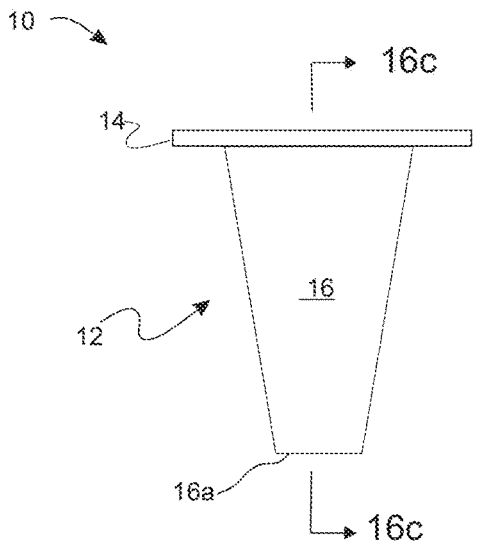
FIG. 16*a* is a front side elevation view of an embodiment of a shelf unit.
Figure 16B:
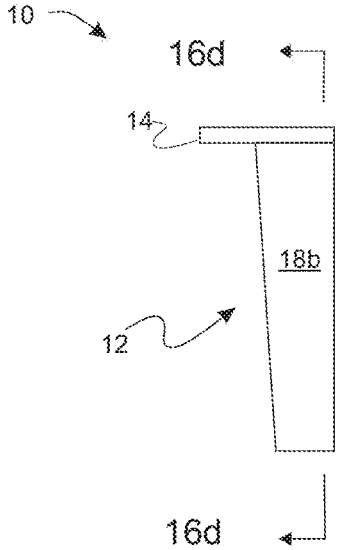
FIG. 16*b* is a left side elevation view of the embodiment of the shelf unit of FIG. 16*a;*
Figure 16C:
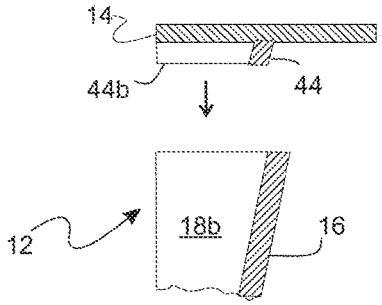
FIG. 16*c* is a cross-sectional partial view of the embodiment of the shelf unit of FIG. 16*a* taken along lines 16*c*-16*c* and showing an exploded view of a shelf mounting configuration.

Referring to FIGS. 16*a*-16*d*, a further feature of the present invention is shown wherein the shelf 14 is configured to be removably disposed on the support shroud 12. FIGS. 16*a* and 16*b* show the shelf unit 10 with the shelf 14 installed on the support shroud 12 and provide cross-sectional view lines for FIGS. 16*c* and 16*d* wherein the shelf 14 is detached from the support shroud 12 to illustrate a mounting configuration of the shelf 14. On an underside of the shelf 14, optionally there are ribs 44, 44*a*, and 44*b* which are configured to fit within a shroud top aperture 19*t* of the support shroud 12. While the front rib 44 and right and left side ribs, 44*a* and 44*b*, are illustrated, it is within the scope of the present invention to use only the front rib 44, or only the side ribs, 44*a* and 44*b*, as the shelf 14, when the support shroud 12 is mounted to the building wall 26, is prevented from sliding backwards by the building wall 26. Hence, using any the aforesaid configurations the shelf 14 may be easily removed from the support shroud 12 to allow access to cabling and wires retained within the support shroud 12.

E2. Fixed Shelf Embodiments.

Figure 16D:
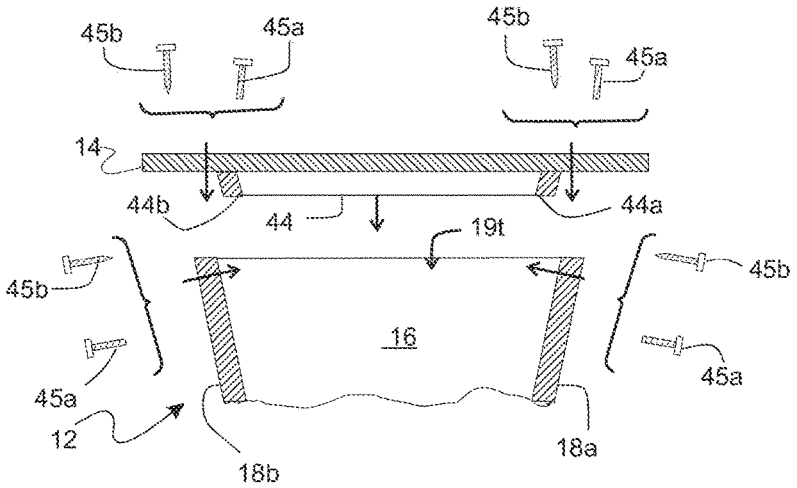
FIG. 16*d* is a cross-sectional partial view of the embodiment of the shelf unit of FIG. 16*a* taken along lines 16*d*-16*d* and showing an exploded view of a shelf mounting configuration.

It is further within the scope of the present invention to mount the shelf 14 to the support shroud 12, as additionally illustrated in FIG. 16*d* in an exploded view, using nails or screws 45*b*, or machine screws 45*a* when threaded inserts (not shown) are installed in the upper edges of the support shroud 12, which pass through a top of the self 14 and optionally into the front or side walls, 16, 18*a*, or 18*b*, of the support shroud 12. In this arrangement, the front and side ribs 44, 44*a*, and 44*b* are optional, and alignment of the shelf 14 on the support shroud 12 is optionally facilitated by pre-drilled holes and/or threaded inserts.

An alternative to the above described mounting wherein the front and/or side ribs, 44, 44*a* or 44*b*, are optional, the shelf 14 is mounted to the support shroud 12 via the aforesaid ribs. The nails or screws 45*b*, or the machine screws 45*a* when threaded inserts (not shown) are installed, are passed through the shroud side walls, 18*a* and 18*b*, (and alternatively or in addition to the shroud front wall 16) and are fastened to the front or side ribs, 44, 44*a*, or 44*b*. In the above configurations wherein screws are used, the shelf 14 is considered to be removably mounted to the support shroud 12 as the screws may be removed and reinserted without deleterious effects.

E3. Second Removable Shelf Embodiment.

Figure 17A:
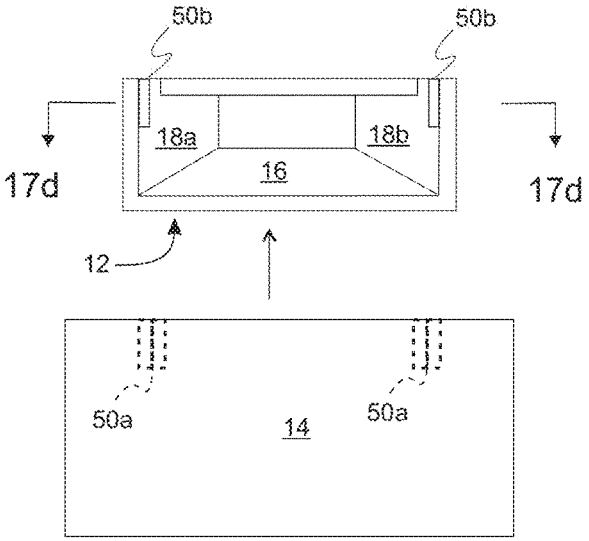
FIG. 17*a* is a top plan exploded view of a shelf unit illustrating a shelf mounting configuration.
Figure 17B:
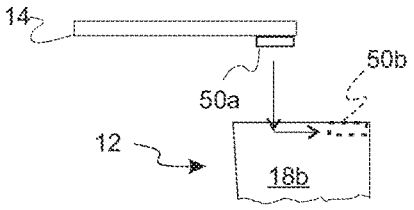
FIG. 17*b* is a side elevation exploded partial view of the shelf mounting configuration of FIG. 17*a;*
Figure 17C:
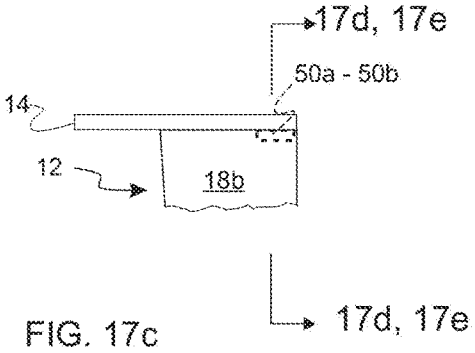
FIG. 17*c* is a side elevation partial view of the shelf mounting configuration of FIGS. 17*a* and 17*b;*
Figure 17D:
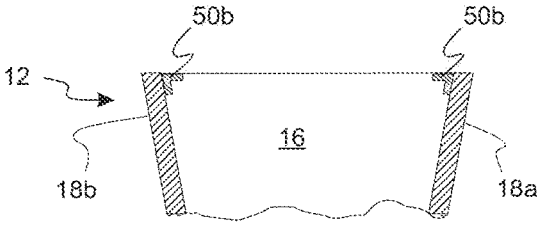
FIG. 17*d* is a cross-sectional partial view of the support shroud of the shelf unit of FIG. 17*a* showing mounting of retainer parts.
Figure 17E:
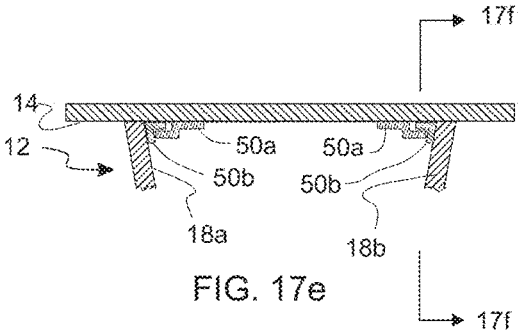
FIG. 17*e* is a cross-sectional partial view of the support shroud of the shelf unit of FIG. 17*a* showing engagement of retainer parts.

Referring now to FIGS. 17*a*-17*f*, in a further removable shelf mounting option the shelf 14 has installed on a bottom side a pair of slide channel guides 50*a* which are configured to engage a pair of slide rib members 50*b* installed on the shroud side walls, 18*a* and 18*b*. The slide channel guides 50*a* and the slide rib members 50*b* are configured to slidably engage one another when the shelf 14 is positioned over a top front half of the support shroud 12 from the position of FIG. 17*a* to the position of FIG. 17*b*, dropped downward onto the support shroud 12 as depicted in FIG. 11*b*, and then slid toward a back of the support shroud 12 into an installed position as shown in FIGS. 17*c* and 17*e*. Referring to FIG. 17*d*, the slide rib members 50*b* are shown installed on the side walls, 18*a* and 18*b*, to present ribs projecting into an interior of the support shroud 12. As shown in FIG. 17*e*, the slide channel guides 50*a*, in conjunction with a bottom surface of the shelf 14, define grooves into which the ribs slide and engage the shelf 14 with the support shroud 12.

Figure 17F:
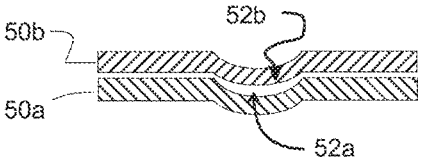
FIG. 17*f* is a cross-sectional view of an embodiment of the retainer parts of FIGS. 17*a*-17*s* taken along lines 17*f*-17*f* of FIG. 17*f* and showing an optional detent configuration.

A further optional feature is shown if FIG. 17*f* wherein the slide channel guide 50*a* and slide rib member 50*b* are configured to create a detent catch by virtue of the slide rib member 50*b* presenting a protrusion 52*b* which engages a recess 52*a* of the slide channel guide 50*a*. When slid together the slide channel guide 50*a* deflects a small amount until the protrusion 52*b* is positioned in the recess 52*a*. The engagement acts to prevent the shelf 14 from sliding outward from the building wall 26 (not shown) unless sufficient dislodging force is applied. Alternatively, the protrusion 52*b* and the recess 52*a* may be respectively formed in the slide channel member 50*a* and the slide rib member 50*b*.

E4. Hinged Shelf Embodiment.

Various engagement options are described above for engaging the shelf 14 with the support shroud 12, which options may be used in conjunction with any of the aforesaid configurations and features of the shelf unit of the present disclosure. A still further shelf engagement option is to hinge the shelf 14 from any of the shroud front wall 16, the shroud side walls, 18*a* or 18*b*), or a cross member 32 suitably fixed to the shroud side walls, 18*a* and 18*b*. This option may also be used in any of the shelf unit embodiments described herein, and is optionally used in conjunction with any of the access door embodiments describe in this disclosure.

E5. Shelf Mounting Summary.

Given the above plethora of shelf engagement options, it is still emphasized that the recitation of engagement options described herein is not exhaustive nor exclusive and employment of other engagement configurations is considered to be within the scope and spirit of the present invention. Various types of joining hardware exist that may be used to mount the shelf which may be employed and are considered to be within the scope and spirit of the present invention.

F. Joining Methods.

With regard to the preceding features and constructions of the shelf unit 10, although not illustrated for purpose of clarity, panels of the support shroud 12 are optionally mounted together using known joinery configurations, adhesive compositions, or joining devices such as brackets, biscuits, corner blocks, screws, nails, stable, and/or pegs, in such a manner that the panels are joined in a manner obviating a need for a cross member. Still further, instead of the shelf 14 being fixedly or removably mounted as discussed above, the self 14 is optionally fixedly mounted using any of the aforesaid methods to provide structural integrity.

The mounting of the shelf unit 10 to the building wall 26 is done as described above, optionally using one cross member 32 or French cleat cross member 30*a* for wall mounting purposes. For most applications, given the compact and lightweight nature of modern electronics to be supported by the shelf unit 10, large load bearing capabilities of the shelf unit 10 are not required.

G. Dimension Ranges.

G1. Shroud Bottom Aperture Dimension.

Various embodiments are set forth above of a support shroud, e.g., embodiments designator 12 through 12*i*, which have an opening at a bottom thereof, referred to as a shroud bottom aperture 19-1 and shown in FIGS. 1*a*-1*c*. In the following discussion reference shall be made to the support shroud 12 with the understanding that said reference also includes the further embodiments disclosed above. In the foregoing embodiments, the support shroud 12 defines the first shroud bottom aperture 19-1 designated in FIGS. 1*a*-1*c* defined by the shroud front wall 16, right and left shroud side walls 18*a* and 18*b*, the building wall 26. The second shroud bottom aperture 19-2 is designated in FIG. 8*d* and is similarly defined and differs only in that it is larger due to adaptation to the two gang wall outlet 24-2. The dimension of either of the apertures is characterized by the shroud bottom interior width D3*i* and the shroud bottom interior depth D6*i*. For the purpose of the following discussion, reference will simply be made to the shroud bottom aperture with corresponding dimensioning determining application thereof.

It is to be also understood that while dimensioning of the shroud bottom aperture is discussed below, in embodiments of this disclosure having an access door configuration, a bottom aperture is optionally omitted, i.e., a bottom of the support shroud maybe closed because access to the wall outlet is provided by the aforesaid alternative access configurations. Furthermore, in such embodiments, the shroud bottom aperture is optionally dimensioned without manual access considerations.

A minimum depth D6*i* is determined by a protrusion of a standard plug when inserted in an outlet and allowing for a bend of a typical electric cord, and this depth is about 2 inches which presumes that the plug is inserted into the wall outlet 24 prior to mounting the support shroud 12 onto the building wall and that a 16 gauge cord thereof has a bending radius of about ½ inch. If hand access to the wall outlet 24 is to be allowed, the minimum depth D6*i* is 2¾ inches which allows for the standard plug to be disengaged from the wall outlet 24 and removed with the support shroud 12 installed over the wall outlet 24, and likewise for a standard plug to be inserted. However, many electronic devices do not have a standard dimensioned plug at the end of a cord but instead have an AC adaptor which at a minimum requires a depth of 3 inches for manual insertion and removal with the support shroud 12 in place.

The shroud bottom interior depth D6*i* determines whether one may access plugs inserted into the wall outlet 24 by inserting their hand upward through the shroud bottom aperture. While the depth is optionally increased to allow any desired clearance, it is an optional feature of the present invention that the depth be limited to a range wherein hand access is afforded to the wall outlet 24 and retention of wires within the support shroud 12 is also effected.

The support shroud interior width D3*i* is determined by factors such as a standard faceplate width of the wall outlet 24 or 24-2, a typical hand width for allowing manual access, whether a one gang 24 or two gang wall outlet 24-2 is involved, and whether AC adaptors are to be used. At a minimum, the width should sufficient to encompass a standard wall faceplate (one gang) which is about 2¾ inches with this dimension not considering manual access and being applicable to situations where a power/communication cord is inserted into the wall outlet prior to installation of the shelf unit 10. If manual access is intended, a minimum width is about 3½ inches to allow clearance for an average hand. If a two gang wall outlet is involved, a minimum width is 4¾ inches to provide clearance for the outlet faceplate.

The configuration of AC adaptors varies. Most AC adaptors are cubical and have about 2 inch sides thus falling within an envelope of a standard faceplate. Others AC adaptors are horizontally offset to avoid blocking receptacles above or below a receptacle into which the adaptor is plugged. These sideways AC adaptors typically extend horizontally about 2 inches beyond a side of a faceplate of the wall outlet. Thus, if the support shroud is to accommodate such adaptors then a minimum width is 4¾ for a one gang outlet, with a single sideways AC adaptor, and with a center of the support shroud being offset with respect to the wall outlet. If the support shroud is to accommodate a one gang outlet with dual sideways AC adaptors extending in opposite directions the minimum width is 6¾ inches. Two gang outlets are 2 inches wider than one gang outlets, hence two inches may be added to the aforesaid dimensions.

Another feature of embodiments of the present invention is that the bottom aperture be dimensioned to allow retention of extra length of wires and power cords from the electronic device 22 within the support shroud 12 without need of cord bundling devices such as wire ties or retention devices such as, for example and not limitation, hooks, cleats, straps or pockets within an interior of the support shroud. This feature is effected by virtue of the dimension of the bottom aperture, in combination with the protrusion of one or more plug units 28 or AC adaptors, serving to block wires and power cords from falling below the front wall bottom edge 16*a*, and in combination with wire stiffness limiting a radius of wire bending under its own weight when allowed to settle with the support shroud.

By the aforesaid configurations and conditions, cords and wires are prevented from falling below the front wall bottom edge 16*a*, and preferably are kept above the wall outlet 24 with the exception of portions extending to plugs or AC adaptors. To provide the retention feature for 16 gauge wiring, a maximum of 6 inches is optionally added to the above width dimensions and a maximum of 3 inches is added to the depth dimensions to determined ranges for width and depth of the support shroud bottom aperture. Preferably, for smaller wiring, a maximum of 5 inches is optionally added to the above width dimensions and a maximum of 2½ inches is added to the depth dimensions to determined ranges for width and depth of the support shroud bottom aperture. Still more preferably, for light gauge wiring, such as for example 18 gauge and above, a maximum of 4 inches is optionally added to the above width dimensions and a maximum of 2 inches is added to the depth dimensions to determined ranges for width and depth of the support shroud bottom aperture.

Given the above considerations, optional ranges of the shroud bottom interior width D3*i* and the shroud bottom interior depth D6*i* are presented in tables below for one and two gang outlets.

TABLE 1

| Range Description - Application | D3i (width) Min. in. | D3i (width) Max. in. |
|---|---|---|
| One gang, no sideways adaptor, no manual access TO two gang - dual sideways AC adaptors (extending in opposite directions), 16 Gauge | 2 - 3/4 | 14 -3/4 |
| One gang, no sideways adaptor, no manual access TO two gang - dual sideways AC adaptors (extending in opposite directions), 18 Gauge | 2- 3/4 | 13 - 3/4 |
| One gang, no sideways adaptor, no manual access TO two gang - dual sideways AC adaptors (extending in opposite directions), 20 Gauge | 2 -3/4 | 12 - 3/4 |
| One gang, no sideways adaptor, manual access TO two gang - dual sideways AC adaptors (extending in opposite directions), 16 Gauge | 3 - 1/2 | 14 - 3/4 |
| One gang, no sideways adaptor, manual access TO two gang - dual sideways AC adaptors (extending in opposite directions), 18 Gauge | 3 - 1/2 | 13 - 3/4 |
| One gang, no sideways adaptor, manual access TO two gang - dual sideways AC adaptors (extending in opposite directions), 20 Gauge | 3 - 1/2 | 12 - 3/4 |

TABLE 1-continued

| Range Description - Application | D3i (width) Min. in. | D3i (width) Max. in. |
|---|---|---|
| One gang, no sideways adaptor, manual access TO two gang - single sideways AC adaptor (offset mount), 16 Gauge | 3 - 1/2 | 12 - 3/4 |
| One gang, no sideways adaptor, manual access TO two gang - single sideways AC adaptor (offset mount), 18 Gauge | 3 - 1/2 | 11 - 3/4 |
| One gang, no sideways adaptor, manual access TO two gang - single sideways AC adaptor (offset mount), 20 Gauge | 3 - 1/2 | 10 - 3/4 |
| One gang, no sideways adaptor, manual access TO two gang - 16 Gauge | 3 - 1/2 | 10 - 3/4 |
| One gang, no sideways adaptor, manual access TO two gang - 18 Gauge | 3 - 1/2 | 9 - 3/4 |
| One gang, no sideways adaptor, manual access TO two gang - 20 Gauge | 3 - 1/2 | 8 - 3/4 |
| One gang, no sideways adaptor, manual access TO one gang - two sideways adaptors, 16 Gauge | 3 - 1/2 | 12 - 3/4 |
| One gang, no sideways adaptor, manual access TO one gang - two sideways adaptors, 18 Gauge | 3 - 1/2 | 11 - 3/4 |
| One gang, no sideways adaptor, manual access TO one gang - two sideways adaptors, 20 Gauge | 3 - 1/2 | 10 - 3/4 |
| One gang, no sideways adaptor, manual access TO one gang - one sideways adaptor, 16 Gauge | 3 - 1/2 | 10 - 3/4 |
| One gang, no sideways adaptor, manual access TO one gang - one sideways adaptor, 18 Gauge | 3 - 1/2 | 9 - 3/4 |
| One gang, no sideways adaptor, manual access TO one gang - one sideways adaptor, 20 Gauge | 3 - 1/2 | 8 - 3/4 |
| One gang, no sideways adaptor, manual access TO one gang, no sideways adaptor - 16 Gauge | 3 - 1/2 | 8 - 3/4 |
| One gang, no sideways adaptor, manual access TO one gang, no sideways adaptor - 18 Gauge | 3 - 1/2 | 7 - 3/4 |
| One gang, no sideways adaptor, manual access TO one gang, no sideways adaptor - 20 Gauge | 3 - 1/2 | 6 - 3/4 |

TABLE 2

| Range Description - Application | D6i (depth) Min. in. | D6i (depth) Max. in. |
|---|---|---|
| No adaptor, no manual access TO with AC adaptor, manual access, 16 Gauge | 2 | 6 |
| No adaptor, no manual access TO with AC adaptor, manual access, 18 Gauge | 2 | 5 - 1/2 |
| No adaptor, no manual access TO with AC adaptor, manual access, 20 Gauge | 2 | 5 |
| No adaptor, no manual access TO no AC adaptor, manual access, 16 Gauge | 2 | 5 - 3/4 |
| No adaptor, no manual access TO no AC adaptor, manual access, 18 Gauge | 2 | 5 - 1/4 |
| No adaptor, no manual access TO no AC adaptor, manual access, 20 Gauge | 2 | 4 - 3/4 |
| No adaptor, manual access TO with AC adaptor, manual access, 16 Gauge | 2 - 3/4 | 6 |
| No adaptor, manual access TO with AC adaptor, manual access, 18 Gauge | 2 - 3/4 | 5 - 1/2 |
| No adaptor, manual access TO with AC adaptor, manual access, 20 Gauge | 2 - 3/4 | 5 |
| No adaptor, manual access TO no AC adaptor, manual access, 16 Gauge | 2 - 3/4 | 5 - 3/4 |
| No adaptor, manual access TO no AC adaptor, manual access, 18 Gauge | 2 - 3/4 | 5 - 1/4 |
| No adaptor, manual access TO no AC adaptor, manual access, 20 Gauge | 2 - 3/4 | 4 - 3/4 |

G2. Shroud Top and Shelf Dimensions.

In the various embodiments discussed above of the support shroud 12, dimensions of a top of the support shroud are defined by the shroud front wall 16, and the right and left shroud side walls 18*a* and 18*b*, are referred to as a shroud top dimension having an outer dimension of characterized by the shroud top D1*w* and the shroud top depth D1*d*. For the purpose of the following discussion, reference will simply be made to the shroud top. It is to be also understood that while dimensioning of the shroud top is discussed below, such dimensioning is considered to be optional and will vary based upon the shelf 14 which it supports and application thereof.

The shroud top is dimensioned taking into consideration the shelf 14 and its various embodiments, referred to below as simply the shelf. The shelf is optionally configured to have the shelf width D7*w* and the shelf depth D7*d* dimensioned in accordance with a desired application. For example, the shelf may be configured to support small electronic devices with a footprint of about 3 inches by 3 inches in the case of cordless phone chargers or clocks, for example and not limitation, or larger electronic devices such as televisions, computers, audio equipment, printers, or other devices. Thus, an optional small dimension for the shelf depth D7*d* is about 6", with larger dimensions being on the order of about 18 inches to about 24 inches, which may be provided in 2 inch increments. Similarly, the shelf width D7*w* is likewise dimensioned such that the shelf accommodate a footprint of devices disposed thereon. In the case of the embodiment of FIG. 8*a* wherein two shelf support shrouds 12 are used, the shelf width D7*w* will depending upon the particular application, for example the wall outlet placement, a width of the building wall 26, or a number of devices or an otherwise desired use of the shelf.

A further consideration in determining the shroud top dimension is a desired interior volume of the support shroud. This volume is dictate by a volume of cords, or cables, to be contained therein. Such a volume is generally not large so that it is generally sufficient that at a minimum the shroud top dimension be commensurate with outer dimensions of the shroud bottom, yielding a non-tapered configuration. If such a configuration is to support larger shelves, and a weight load dictates reinforcement the shelf to prevent splitting along a longitudinal axis, metal brackets may be incorporated at the shroud top to extend out from the support shroud to a distance about 1 or 2 inches less that the shelf depth D7*d*.

In some applications electronic devices incorporate larger AC adapters than those which directly plug into a wall outlet. Such larger AC adaptors are disposed at an intermediary position of a power cord extending from a given device. This is common in the case of laptop/notebook computers, displays of printers for example and not limitation. An upper end size envelope of such an adaptor is about 4 inches square extending about 10 inches in length. Thus, to allow clearance for cords and cables when such a larger adaptor is to be contained within the support shroud, it is optionally provided that the shroud top dimension be on the order of 8 inches in width and 4 inches in depth, assuming ¾ inch thick walls, hence an interior dimension of the 6½ inches in width and 3¼ inches in depth.

Generally, it is desirable but not required that the support shroud top depth be 1 to 2 inches less than a depth of the shelf which it supports. Similarly, and since wooden shelves are stronger along a longitudinal length going with the grain, the support shroud top width D7*w* is dimensioned 2 to 8 inches less than that of a shelf it supports.

The above dimensional considerations for the support shroud top are optional and depend upon a given application and a strength of materials employed. For example, shelves formed of a metal construction, thick glass, ceramic, or stone will have differing strengths an may not require the support shroud top be as large as suggested above.

G3. Support Shroud Height.

In the following discussion reference will simply be made to the support shroud and the self with the understanding that reference is being made generally to the above embodiments discussed above. The support shroud is shown in FIG. 1*a* as having the height D2.

As discussed above, the Americans with Disabilities Act (ADA) stipulates that a bottom of an outlet box be a minimum of 15" above the floor 27, and typical installations are in the range of 12" to 16" above the floor 27.

It is an option of the present disclosure to provide the support shroud in heights directed to selected applications. The support shroud of the raised outlet embodiment of FIG. 12*a* is shortest in height having a range of about 5 to 12 inches. This also coincides with the coffee table height embodiment. The remaining embodiments of the support shrouds have height ranges dictated by a outlet height D4 and an application height. The ranges of height previously mentioned are as follows:

1. a coffee table height range which is about 16" to 18".
2. a desk height range which is about 28" to about 30"; and
3. a standing work table has a height in the range of about 34" to about 46";

Assuming a shelf thickness of 1 one inch for purposes of simplicity, the following support shroud height D2 ranges are determined and presented in the table below.

| Range Description - Application | D2 (height) Min. in. | D2 (height) Max. in. |
|---|---|---|
| Coffee Table Height 16" to 18" | 5 | 12 |
| Desk Height 28" to 30" | 9 | 17 |
| Desk Height 28" to 30", ADA 15" outlet height | 12 | 14 |
| Work Table Height 34" to 46" | 17 | 33 |
| Work Table Height 34" to 46", ADA 15" outlet height | 18 | 30 |

In practice, it is desirable to produce the support shroud in 2 inch increments so as to cover the ranges presented above.

H. Methods of Use.

Dimensioning of the shroud bottom aperture is optionally configured based on modes of installation and application of the shelf unit 10. Methods are presented below and it is to be understood that reference to a plug unit 28, is intended to also refer to any type connector which may be connected to any embodiment of a wall outlet described. Likewise, reference to the wall outlet 24 is merely exemplary and any wall outlet embodiment is intended The support shroud and shelf configurations disclosed herein are configured to provide a means and method for support of a shelf, concealment of a wall outlet and associated connections thereto, and management of power cords, cabling, and wires associated with electronic devices making a wired connection to an outlet in a building wall. Within this disclosure, references to power cords, cabling, and wires are used interchangeably as a function of any given is solely determined by a type of destination receptacle. Presented below are various methods of use fro embodiments a shelf units described herein. Inherent in these methods is the provision of a shelf unit in accordance with the scope and spirit of this disclosure, and its application to given situation.

The method of use for a shelf unit embodiment with a fixedly mounted shelf is as follows:

Method 1

1. Determine location of wall attachment device, of which embodiments are shown in FIGS. 2*a*-5, to locate a bottom edge of support shroud of an embodiment of this disclosure at about a bottom edge of the wall outlet (24, 24-2).

2. Fix support shroud to the building wall 26 by engagement of wall attachment device mounted to the support shroud to the previously mounted mating wall attachment device.
3. Place the electronic device 22 on the shelf 14.
4. Feed the device cable, e.g., the plug unit 28 and the cord 29, through the shelf aperture 15 and so the plug unit 28 drops down to an area of the wall outlet (24, 24-2, or variant) and a remainder of the cord 29 is loosely dispersed with an interior of the shroud above the wall outlet.
5. Insert hand through the support shroud bottom aperture (19-1 or 19-2), and insert the plug unit 28 into the wall outlet (24, 24-2 or variations).

Method 2

1. Determine location of wall attachment device, of which embodiments are shown in FIGS. 2*a*-5, to locate a bottom edge of support shroud of an embodiment of this disclosure at about a bottom edge of the wall outlet (24, 24-2).
2. Holding shelf unit, place the electronic device 22 on the shelf 14.
3. Dispose the device cable, e.g., the plug unit 28 and the cord 29, through the shelf aperture 15 and position the plug unit 28 to the shroud bottom edge and loosely disperse a remainder of the cord 29 in an interior of the support shroud above the shroud bottom edge.
4. Fix support shroud to the building wall 26 by engagement of wall attachment device mounted to the support shroud to the previously mounted mating wall attachment device.
5. Insert hand through the support shroud bottom aperture (19-1 or 19-2), and insert the plug unit 28 into the wall outlet (24, 24-2 or variations).

In the above methods 1 and 2, since the shelf 14 is fixed, the cord 29 is either feed through the support shroud 12 after installation or placed in the support shroud 12 before installation. The cord 29 is disposed in any of a coiled looped configuration, a serpentine configuration, or a combination thereof such that, an inherent stiffness of the cord 29 in combination with engagement of the tapered interior of the support shroud 12 and the plug unit 28 being inserted in and protruding from the wall outlet 24, the cord 29 is retained above the front wall bottom edge 16*a*.

In methods 1 and 2 above, the support shroud is dimensioned for manual access. In an embodiment of the support shroud which is not dimensioned for manual access the following method is used.

Method 3

1. Determine location of wall attachment device, of which embodiments are shown in FIGS. 2*a*-5, to locate a bottom edge of support shroud of an embodiment of this disclosure at about a bottom edge of the wall outlet (24, 24-2).
2. Holding shelf unit, place the electronic device 22 on the shelf 14 of the support shroud embodiment.
3. Dispose the device cable, e.g., the plug unit 28 and the cord 29, through the shelf aperture 15, and position the plug unit 28 to the shroud bottom edge and loosely disperse a remainder of the cord 29 in an interior of the support shroud above the shroud bottom edge.
4. Insert the plug unit 28 into the wall outlet.
5. Fix support shroud to the building wall 26 by engagement of wall attachment device mounted to the support shroud to the previously mounted mating wall attachment device.

Other embodiments of the support shroud of the present invention include access doors for plugging and unplugging plug units of electronic devices into the wall outlet. This construction is suited to the following Method 4 of installation.

Method 4

1. Determine location of wall attachment device, of which embodiments are shown in FIGS. 2*a*-5, to locate a bottom edge of support shroud of an embodiment of this disclosure at about a bottom edge of the wall outlet (24, 24-2) and mount the wall attachment device.
2. Fix support shroud to the building wall 26 by engagement of wall attachment device mounted to the support shroud to the previously mounted mating wall attachment device.
3. Place the electronic device 22 on the shelf 14.
4. Feed the device cable, e.g., the plug unit 28 and the cord 29, through the shelf aperture 15 and so the plug unit 28 drops down to an area of the wall outlet (24, 24-2, or variant) and a remainder of the cord 29 is loosely dispersed with an interior of the shroud above the wall outlet.
5. Open access door.
6. Insert hand through the access door opening, and insert the plug unit 28 into the wall outlet (24, 24-2 or variations).
7. Close access door to conceal and protect the wall outlet and the plug unit 28.

The methods presented above assume a fixedly mounted shelf, and in the case of Method 2, that the plug unit 28 fits through the shelf aperture 15. Some electronic device may have more cabling to contend with and different sizes of adaptors involved that do not necessarily fit through the shelf aperture 15, such a AC power adaptors for computers or displays. In such instances, a shelf unit embodiment with a removable or open-able shelf may be employed, and the following method is optionally used.

Method 5

1. Determine location of wall attachment device, of which embodiments are shown in FIGS. 2*a*-5, to locate a bottom edge of support shroud of an embodiment of this disclosure at about a bottom edge of the wall outlet (24, 24-2) and mount the wall attachment device to the building wall.
2. Fix support shroud to the building wall 26 by engagement of wall attachment device mounted to the support shroud to the previously mounted mating wall attachment device.
3. Detach or open the shelf if not already detached or opened.
4. Feed the device cable(s), e.g., the plug unit 28 and the cord 29 along with any AC adaptor, into the interior of the support shroud with connector ends extending down to an area of the wall outlet (24, 24-2, or variant) and a remainder of the cord 29 is loosely dispersed with an interior of the shroud above the wall outlet.
5. Replace or close the shelf while aligning the cable(s) with the shelf aperture to pass therethrough.
6. Place the electronic device 22 on the shelf 14.
7. Open access door.
8. Insert hand through the access door opening, and insert the plug unit 28, or other connectors into the wall outlet (24, 24-2 or variations).
9. Close access door to conceal and protect the wall outlet and the plug unit 28.

CONCLUSION

Described above are shelf units incorporating various embodiments of a support shroud and various embodiments of a shelf support by the support shroud. The variations of the embodiments described are considered to be interchangeable amongst the embodiments described. The embodiments of the shelf unit are described in applications involving connections to a wall outlet wherein the support shroud serves to cover wiring. However, the shelf units are not to be considered limited to such applications and may be employed absent cooperation with a wall outlet. Hence, the term "shroud" a is not considered to limit the present invention to applications covering wiring, the support shroud may also be considered to serve simply as a shelf support structure but is considered a "shroud" in the sense it covers unsightly mounting devices fix the support shroud to a building wall.

While particular embodiments of the present invention have been shown and described, it will be appreciated by those skilled in the art that, based upon the teachings herein, changes and modifications may be made without departing from this invention and its broader aspects and, therefore, the appended claims are to encompass within their scope all such changes and modifications as are within the true spirit and scope of this invention. The true spirit and scope is considered to encompass devices and processes, unless specifically limited to distinguish from known subject matter, which provide equivalent functions as required for interaction with other elements of the claims and the scope is not considered limited to devices and functions currently in existence where future developments may supplant usage of currently available devices and processes yet provide the functioning required for interaction with other claim elements. Furthermore, it is to be understood that the invention is solely defined by the appended claims.

It is also to be further understood that the doctrine of claim differentiation is to be applied across an independent claim and its dependents and is not intended to be applied across a plurality of independent claims. For example, term A in a first independent may be interpreted to have the same scope as term B in second independent claim, while if term A is in a first independent claim and term B further defines term A in a claim dependent from the first independent claim, then term A must have a broader scope than term B. In other words, phrases that differ from one independent claim to another independent claim, may be interpreted to have equal scope and read on common structure yet present the structure using different terminology in order account for differing interpretation of phrase language.

What is claimed is:

1. A shelf unit comprising:

a shelf having a top side and a bottom side, and an aperture configured as one of a notch or a hole creating an opening between said top side and said bottom side;

a support shroud having a shroud front side, a shroud back, a shroud top portion including a shroud top end, and a shroud bottom portion, said support shroud defining a channel extending from said shroud bottom portion to said shroud top portion and sufficiently shrouded to restrict manual access from said front side into said channel; and said shelf being disposed at said shroud top portion with said aperture providing access to said channel.

2. The shelf unit of claim 1 further comprising an electrical outlet module mounted in said support shroud and having an outer electrical outlet socket exposed outside said support shroud, an inner electrical outlet socket exposed within said channel, and an electrical input connector exposed at a back side of said shroud concavity configured for electrical connection to a wall outlet.

3. The shelf unit of claim 1 wherein said shelf extends laterally outward beyond said support shroud.

4. The shelf unit of claim 3 wherein said channel has a bottom channel cross-sectional area has a depth in a range of about 2 inches to about 6 inches and a width in a range of about 3 and ½ inches to 12 and ¾ inches.

5. The shelf unit of claim 4, wherein said bottom channel cross-sectional area has a depth in a range of about 2 and ¾ inches to about 5 inches and a width in a range of about 3 and ½ inches to 6 and ¾ inches.

6. A shelf unit installation including the shelf unit of claim 1 and comprising:

a building wall having a wall outlet providing connection to at least one of a power source or a communication source;

said support shroud being disposed adjacent to said building wall with said back side adjacent said building wall and said support shroud shrouding said wall outlet from frontal view; and said wall outlet being in communication with said channel.

7. The shelf unit installation of claim 6 wherein said shelf unit is mounted to said building wall.

8. The shelf unit installation of claim 6 further comprising an electrical outlet module mounted in said support shroud and having an outer electrical outlet socket exposed outside said support shroud, an inner electrical outlet socket exposed within said channel, and an electrical input connector exposed at a back side of said shroud concavity configured for electrical connection to a wall outlet.

9. The shelf unit of claim 1 wherein said support shroud includes vertically extending left and right shroud sides, and said channel is closed to frontal and left and right side access from said shroud bottom portion to said shroud top portion by said support shroud.

10. A shelf unit, comprising:

a shelf having a top side and a bottom side;

a support shroud having a shroud top portion and a shroud bottom portion;

said shelf being disposed at said shroud top portion;

said support shroud having a front side and a back side;

said support shroud defining a channel extending from said shroud bottom portion to said shroud top portion and sufficiently shrouded to restrict manual access from said front side into said channel, said channel being open to said back side, and said channel having a channel top end open to said bottom side of said shelf and a bottom channel portion having a bottom channel cross-sectional area;

said channel top end having a top channel cross-sectional area larger than said bottom channel cross-sectional area such that said channel of said support shroud has a tapering configuration tapering inward with advancement in a descending direction; and said shelf defining an aperture configured as one of a notch or a hole providing access to said channel from above said shelf.

11. The shelf unit of claim 10 wherein said bottom channel cross-sectional area has a depth in a range of about 2 inches to about 6 inches and a width in a range of about 3 and ½ inches to 12 and ¾ inches.

12. The shelf unit of claim 11 wherein said support shroud has a height in a range of about 9 inches to about 17 inches.

13. The shelf unit of claim 11 wherein said support shroud has a height in a range of about 17 inches to about 33 inches.

14. The shelf unit of claim 11 wherein said support shroud has a trapezoidal shape and comprises a shroud wall including a front wall, a left side wall, and a right side wall which are inclined inward with advancement in a descending direction.

15. The shelf unit of claim 11 further comprising:

an interior shelf supported within said support shroud; and said shelf being displaceably mounted to the support shroud permitting access to said interior shelf.

16. The shelf unit of claim 10, wherein said support shroud includes an access panel displaceably mounted and arranged to permit access to said channel.

17. The shelf unit of claim 16 wherein said access panel is rotatably mounted to the support shroud via a rotatable connection to the shelf.

18. The shelf unit of claim 10 further comprising an electrical outlet module mounted in said support shroud and having an outer electrical outlet socket exposed outside an outer surface of said support shroud, an inner electrical outlet socket exposed within said channel, and an electrical input connector exposed to at a back side of said support shroud and configured for electrical connection to a wall outlet.

19. The shelf unit of claim 18 wherein said electrical input connector is a corded electrical plug.

20. The shelf unit of claim 18 wherein said electrical input connector is a corded electrical plug.

21. The shelf unit of claim 10 wherein said shelf extends laterally outward beyond said support shroud.

22. The shelf unit of claim 10 wherein said support shroud includes vertically extending left and right shroud sides, and said channel is closed to frontal and left and right side access from said shroud bottom portion to said shroud top portion by said support shroud.

23. A shelf unit installation, comprising:

a shelf unit including:

a shelf having a top side and a bottom side;

a support shroud having a shroud top portion and a shroud bottom portion;

said shelf being disposed on said support shroud at said shroud top portion;

said support shroud having a front side and a back side;

said shroud wall defining a channel extending from said shroud bottom portion to said shroud top portion and sufficiently shrouded to restrict manual access from said front side into said channel, said channel being open to said back side, and said channel having a channel top end open to said bottom side of said shelf and a bottom channel portion;

a building wall having a wall outlet providing connection to at least one of a power source or a communication source;

said shelf unit being positioned adjacent said building wall with said back side adjacent said building wall and said support shroud shrouding said wall outlet from frontal view; and said shelf defining an aperture in communication with said channel to extend said channel from above the shelf to said wall outlet.

24. The shelf unit installation of claim 23 further comprising:

an electronic device situated on said shelf and having a connection cable functionally connected to said wall outlet via passage through said shelf aperture and within said channel;

said support shroud shrouding a portion of said connection cable situated below said shelf to restrict manual access from said front side;

said channel having a top channel cross-sectional area and said bottom channel portion having a bottom channel cross-sectional area;

said top channel cross-sectional area being larger than said bottom channel cross-sectional area such that said channel of said support shroud a has a tapering configuration tapering inward with advancement in a descending direction; and said connection cable being restricted from falling below said channel by said tapering configuration of said channel in conjunction with said building wall.

25. The shelf unit installation of claim 23, further comprising said support shroud having an access panel situated proximate said wall outlet and displaceable to provide access into said channel at said wall outlet.

26. The shelf unit installation of claim 23 further comprising:

an electronic device situated on said shelf and having a connection cable functionally connected to said wall outlet via passage through said shelf aperture and said channel; and said connection cable being shrouded from manual access from said front side by containment within said support shroud.

27. The shelf unit installation of claim 23 further comprising an electrical outlet module mounted in said support shroud and having an outer electrical outlet socket exposed outside an outer surface of said support shroud, an inner electrical outlet socket exposed within said channel, and an electrical input connector exposed to at a back side of said support shroud and configured for electrical connection to a wall outlet.

28. The shelf unit installation of claim 23 wherein said shelf extends laterally outward beyond said support shroud.

29. The shelf unit installation of claim 23 wherein said shelf unit is mounted to said building wall.

30. The shelf unit installation of claim 23 wherein said channel has a bottom channel cross-sectional area having a depth in a range of about 2 inches to about 6 inches and a width in a range of about 3 and ½ inches to 12 and ¾ inches.

31. The shelf unit installation of claim 30, wherein said bottom channel cross-sectional area has a depth in a range of about 2 and ¾ inches to about 5 inches and a width in a range of about 3 and ½ inches to 6 and ¾ inches.

32. The shelf unit installation of claim 23 further comprising an electrical outlet module mounted in said support shroud and having an outer electrical outlet socket exposed outside an outer surface of said support shroud, an inner electrical outlet socket exposed within said channel, and an electrical input connector exposed to at a back side of said support shroud and configured as one of a plug integral with a housing of said electrical outlet module or a corded plug extending from said housing of said electrical outlet module and in electrical connection with said wall outlet.

33. The shelf unit of claim 23 wherein said support shroud includes vertically extending left and right shroud sides, and said channel is closed to frontal and left and right side access from said shroud bottom portion to said shroud top portion by said support shroud.

34. A method of containing cabling communicating an electronic device with a wall outlet, comprising:

providing a shelf having a top side, a bottom side, and a shelf aperture;

providing a support shroud having a front side, a back side, a shroud bottom portion, a shroud top portion, and said support shroud defining a channel extending from said shroud bottom portion to said shroud top portion and sufficiently shrouded to restrict manual access from said front side into said channel, said channel being open to said back side, said channel having a channel top open end;

mounting said support shroud on a wall having the wall outlet with said channel is aligned with and open to said wall outlet and said support shroud shrouding the wall outlet from frontal view;

situating said shelf supported by said support shroud at said support shroud top portion with said shelf aperture in communication with said channel;

disposing said electronic device on said shelf; and connecting the cabling of the electronic device to said wall outlet with the cabling extending through said shelf aperture and within said channel and shrouded from frontal view.

35. The method of claim 34, wherein said support shroud wall includes an access panel displaceable relative to a remainder of said support shroud; and said support shroud is positioned with said access panel proximate said wall outlet so as to provide manual access to said wall outlet;

wherein said connecting said cabling with said wall outlet comprises;

accessing an end of the cabling by opening said access panel;

connecting the end of the cabling to the wall outlet;

closing said access panel; and feeding a remainder of the cabling through the shelf aperture such that said cabling remains within said channel.

36. The method of claim 35 further comprising:

configuring said support shroud such that said channel has a tapering configuration tapering inward with advancement in a descending direction and further defined by said channel having a top channel cross-sectional area and a bottom channel cross sectional area, and said top cross-sectional area being larger than said bottom channel cross-sectional area; and setting said bottom channel cross-sectional area to restrict said cabling, in conjunction with said cabling end being connected to the wall outlet and being adjacent said building wall, from falling below said support shroud when said cabling is disposed in said channel after closing said access panel.

37. The method of claim 36 further comprising effecting a rotatable mount connecting said access panel to the support shroud and said opening said access panel includes rotating the access panel.

38. The method of claim 36 further comprising effecting a rotatable mount connecting said access panel to said shelf and said opening said access panel includes rotating the access panel.

39. The method of claim 38, wherein said bottom channel cross-sectional area has a depth in a range of about 2 inches to about 6 inches and a width in a range of about 3 and ½ inches to 12 and ¾ inches.

40. The method of claim 39, wherein said support shroud has a height in a range of about 5 inches to about 33 inches.

41. The method of claim 34, wherein said connecting said cabling with said wall outlet comprises;

feeding the cabling through the shelf aperture such that the cabling reaches the wall outlet;

manually reaching up through a bottom opening of said channel and inserting an end of the cabling into connection with said wall outlet; and feeding a remainder of the cabling through the shelf aperture such that a portion of said cabling below said shelf remains within said channel.

42. The method of claim 41 further comprising:

configuring said support shroud such that said channel has a tapering configuration tapering inward with advancement in a descending direction and further defined by said channel having a top channel cross-sectional area and a bottom channel cross sectional area, and said bottom channel cross-sectional area is smaller than said top channel cross-sectional area; and setting said bottom channel cross-sectional area to restrict said cabling, in conjunction with said cabling end being connected to the wall outlet and being adjacent said building wall, from falling below said support shroud when said cabling is disposed in said channel.

43. The method of claim 42, wherein said bottom channel cross-sectional area has a depth in a range of about 2 and ¾ inches to about 5 inches and a width in a range of about 3 and ½ inches to 6 and ¾ inches.

44. The method of claim 43, wherein said support shroud has a height in a range of about 5 inches to about 12 inches.

45. The method of claim 43, wherein said support shroud has a height in a range of about 9 inches to about 17 inches.

46. The method of claim 43, wherein said support shroud has a height in a range of about 17 inches to about 33 inches.

47. The method of claim 34 wherein:

said support shroud has an electrical outlet module mounted therein and said electrical outlet module has an outer electrical outlet socket exposed outside an outer surface of said support shroud, an inner electrical outlet socket exposed within said channel, and an electrical input connector exposed to at a back side of said support shroud and configured for electrical connection to a wall outlet;

said mounting the support shroud on the wall includes connecting said electrical input connector to said wall outlet; and said connecting the cabling to said wall outlet includes connecting the cabling to the inner electrical socket to effect connection to said wall outlet.

48. The shelf unit of claim 34 wherein said support shroud includes vertically extending left and right shroud sides, and said channel is closed to frontal and left and right side access from said shroud bottom portion to said shroud top portion by said support shroud.

* * * * *